US009423221B2

(12) United States Patent
Bonner

(10) Patent No.: US 9,423,221 B2
(45) Date of Patent: Aug. 23, 2016

(54) MALFUNCTION TRAINING DUMMY ROUND

(71) Applicant: James Dillon Bonner, Smyma, TN (US)

(72) Inventor: James Dillon Bonner, Smyma, TN (US)

(73) Assignee: James Dillon Bonner, Smyrna, TN (US)

( * ) Notice: Subject to any disclaimer, the term of this patent is extended or adjusted under 35 U.S.C. 154(b) by 557 days.

(21) Appl. No.: 13/646,736

(22) Filed: Oct. 8, 2012

(65) Prior Publication Data

US 2014/0096427 A1 Apr. 10, 2014

Related U.S. Application Data

(60) Provisional application No. 61/627,229, filed on Oct. 7, 2011.

(51) Int. Cl.
*F42B 8/08* (2006.01)
*F41A 33/00* (2006.01)

(52) U.S. Cl.
CPC . *F42B 8/08* (2013.01); *F41A 33/00* (2013.01)

(58) Field of Classification Search
CPC ..... F42B 8/00; F42B 8/02; F42B 8/04; F42B 8/08; F42B 8/12; F42B 8/14; F42B 8/16; F42B 5/182; F42B 5/025; F41A 33/00
USPC ..... 102/293, 436, 439, 444, 498, 502, 529
See application file for complete search history.

(56) References Cited

U.S. PATENT DOCUMENTS

| | | | | | |
|---|---|---|---|---|---|
| 119,357 | A * | 9/1871 | Hobbs | F42B 8/02 | 102/444 |
| 3,237,335 | A * | 3/1966 | Kerr | 42/8 | |
| 3,678,609 | A * | 7/1972 | Fazio | 42/96 | |
| 4,442,777 | A * | 4/1984 | Greene | 102/444 | |
| 5,291,832 | A * | 3/1994 | Plummer | 102/444 | |
| 5,315,778 | A * | 5/1994 | Wolford | 42/70.11 | |
| 6,189,454 | B1 * | 2/2001 | Hunt | F42B 12/74 | 102/444 |
| 6,305,290 | B1 * | 10/2001 | Stimmell | F42B 8/08 | 102/439 |
| 6,708,438 | B1 * | 3/2004 | Sorensen | 42/96 | |
| 7,121,033 | B1 * | 10/2006 | Waller | 42/70.11 | |

* cited by examiner

*Primary Examiner* — Stephen M Johnson
*Assistant Examiner* — Benjamin Gomberg
(74) *Attorney, Agent, or Firm* — Ann I. Dennen

(57) ABSTRACT

The present invention is an instrument for simulating malfunctions in firearms during live fire training which could not previously be simulated during live fire training. In some exemplary embodiments the invention approximately matches the external dimensions of an ammunition cartridge with the addition of novel features described herein which modify the interactions between the present invention, firearm magazine assembly and firearm such that a firearm malfunction desirable for malfunction resolution training is simulated. Some exemplary embodiments also include novel features described herein which serve to maintain a desired orientation of the invention in reference to an firearm magazine assembly, an ammunition cartridge or the firearm such that a particular type of firearm malfunction occurs. Some exemplary embodiments include multiple of said novel orientation features such that the user of the invention may select between multiple possible malfunction types.

7 Claims, 29 Drawing Sheets

MALFUNCTION TRAINING DUMMY ROUND

CROSS-REFERENCE TO RELATED APPLICATIONS

The present Application claims priority of U.S. Provisional Application No. 61/627,229, filed Oct. 7, 2011 by the present inventor, titled: Malfunction Training Dummy Round.

FEDERALLY SPONSORED RESEARCH

NONE

SEQUENCE LISTING

NONE

BACKGROUND OF THE INVENTION

Firearm malfunctions are a harsh reality to those who wield firearms in harms way. For this reason, most advanced military and law enforcement entities train their forces in proper firearm malfunction resolution procedures, one example being the FM3-22.9 training manual issued by the United States Department of the Army. As often stressed in this training, familiarization of the firearm operator with the varied types of firearm malfunctions is crucial, as the particular malfunction type encountered must first be identified in order for the firearm operator to perform the most correct and efficient malfunction resolution procedure. This said, actual live fire malfunction resolution training is a requirement for firearm operators who wish to become truly familiar with the varied types of firearm malfunctions and their respective resolution procedures.

Despite the need, the state of the art does not allow for actual live fire malfunction resolution training for the spectrum of malfunctions commonly encountered, and therefore is greatly lacking. Actual live fire firearm malfunctions do not typically occur in a predictable fashion such that they could be used for training, nor do they typically occur consistently enough to allow repeated training on the same type of malfunction, as is required for a high level of proficiency in the skill-sets and knowledge required to efficiently resolve the full spectrum of firearm malfunctions.

It has been attempted to use an item known as a dummy round for live fire malfunction resolution training, however dummy rounds in the state of the art are unsatisfactory as they cannot induce a variety of realistic simulated malfunction types during actual live fire, but instead can only induce a simulated failure to fire malfunction during live fire training. This lack of variety of firearm malfunction types during live fire training can result in a firearm operator insufficient in the skill of recognizing that a malfunction other than a failure to fire has occurred, and realizing that a different resolution procedure is required. It may also result in a firearm operator who is inefficient or ineffectual at resolving more complex and difficult malfunction types, such as bolt over base malfunctions, double feed malfunctions, cartridge over bolt malfunctions and others.

Provided below are a few examples of the state of the art of dummy rounds:

In U.S. Pat. No. 119,357 to Hobbs, described is an improvement to the dummy round by the placement of a rubber disk in the location a primer would be on a live cartridge to prolong the service life of the dummy round and protect the firing mechanism of the host firearm from potential injury. A means for simulating any firearm malfunction during live fire training other than a failure to fire malfunction is not described.

In U.S. Pat. No. 6,189,454 to Hunt, a dummy round is described which primarily features various means to protect the firing pin of the host firearm and increase the service life of the dummy round. A means for simulating any firearm malfunction during live fire training other than a failure to fire malfunction is not described.

The Stimmell et al U.S. Pat. No. 6,305,290 describes a dummy round constructed from an empty cartridge case and an insert made from polymer or a similar material, and the methods for producing the same. A means for simulating any firearm malfunction during live fire training other than a failure to fire malfunction is not described.

As can be seen in the previously described patents which are representative of the state of the art, during live fire training existing dummy rounds can only simulate failure to fire malfunctions in the host firearm. There are many additional types of firearm malfunction other than the failure to fire malfunction which are needed during live fire firearm malfunction resolution training. The current state of the art has not met this need, and there are many desirable aspects of live fire firearm malfunction resolution training which the state of the art cannot provide. This may include but is not limited to:

a) During live fire training the current state of the art cannot simulate firearm malfunctions other than failure to fire malfunctions.
b) The current state of the art cannot be used to simulate a double feed malfunction during live fire training.
c) The current state of the art cannot be used to simulate a bolt over base malfunction during live fire training.
d) The current state of the art cannot be used to simulate a failure to extract malfunction during live fire training.
e) The current state of the art cannot be used to simulate a failure to eject malfunction during live fire training.
f) The current state of the art cannot be used to simulate a failure to feed malfunction during live fire training.
g) The current state of the art cannot be used to simulate a stove pipe malfunction during live fire training.
h) The current state of the art cannot be used to simulate a cartridge over bolt malfunction during live fire training.
i) The current state of the art limits the firearm operator or firearm instructor to unrealistically staging, outside of live fire training, complex malfunctions such as the double feed malfunction, bolt over base malfunctions, etc.
j) The current state of the art does not allow for variability of simulated malfunction type to increase realism during live fire malfunction resolution training.
k) During live fire training the current state of the art does not allow the user to select a malfunction type the user wishes to simulate from several malfunction types.
l) The current state of the art during live fire training cannot be used to immediately induce additional simulated firearm malfunctions of a different nature when a firearm operator employs an incorrect malfunction resolution procedure.

With these facts identified it is clear that the state of the art for firearm malfunction resolution training is lacking. No instrument has previously existed that can accurately simulate a variety of realistic malfunction types in firearms during live fire training. Such an instrument would make a new level of malfunction resolution proficiency possible, and also ease the burden on firearm instructors for one of the most complex and difficult aspects of firearm training.

The following is a tabulation of some patent and literature in the state of the art that presently appears relevant:

| U.S. Patent Documents Pat. No. | Issue Date | Patentee |
|---|---|---|
| U.S. 119,357 | 1871 Sep. 26 | Hobbs |
| U.S. Pat. No. 6,189,454 B1 | 2001 Feb. 20 | Hunt |
| U.S. Pat. No. 6,305,290 B1 | 2001 Oct. 23 | Stimmell et al |

NONPATENT LITERATURE DOCUMENTS

Lamb, Kyle, E., *Green Eyes and Black Rifles*, Trample & Hurdle Publishers (January 2008), ISBN 0-615-16654-7.

United States Department of the Army, *FM*3-22.9, *Rifle Marksmanship M*16-/*M*4-*Series Weapons*, US Army Training and Doctrine Command (August 2008).

BRIEF SUMMARY OF THE INVENTION

The present invention has been developed in response to the present state of the art, and in particular, in response to the problems and needs in the state the art that have not yet been fully solved by the firearm malfunction resolution training methods and instruments currently available. In accordance with the invention as embodied and broadly described herein in the embodiments, a training aid for malfunction resolution training is provided. The present invention is the long awaited solution to many of the inherent problems and difficulties in firearm malfunction resolution training by allowing additional malfunction types to be simulated in a realistic manner during live fire training, and in certain embodiments may additionally provide the option for the user to select and train for a particular malfunction type.

In one exemplary embodiment, the present invention may be described as an instrument approximately matching the external dimensions of a live ammunition cartridge, with the incorporation of a novel feature which, when the invention is used in place of a live ammunition cartridge, alters the interaction between the invention and the firearm or firearm magazine assembly such that a simulated malfunction of the firearm other than a failure to fire will occur. This feature may comprise of voids, protrusions, removed surfaces, modified surfaces or other means.

In another exemplary embodiment, an additional novel orientation feature is incorporated as a means to induce or maintain a desired orientation of the invention while it interacts with the firearm magazine assembly or firearm or live ammunition cartridges, with said desired orientation being of such a nature that it would not be induced or maintained by a live ammunition cartridge in the inventions place. This novel feature may comprise of voids, protrusions, removed surfaces, modified surfaces or other means.

In one exemplary embodiment, the novel orientation feature takes the form of a void or voids along the length of the present inventions side. When the invention is placed into a firearm magazine assembly with additional live ammunition cartridges, these voids lock into adjacent live ammunition cartridges in the firearm magazine assembly such that a desired orientation of the invention in reference to the firearm magazine assembly or firearm is achieved. This desired orientation of the invention may be designed such that it results in a particular malfunction type. By incorporating a multitude of these orientation inducing voids, it becomes possible for the user to select between multiple orientation options for different desired malfunction types.

The Malfunction Training Dummy Round has a number of advantages when compared to the state of the art, which can include but is not limited to:

a) During live fire training, the present invention can simulate many different types of malfunctions, and is not limited to simulating failure to fire malfunctions.
b) The present invention can be used to simulate a double feed malfunction during live fire training.
c) The present invention can be used to simulate a bolt over base malfunction during live fire training.
d) The present invention can be used to simulate a failure to extract malfunction during live fire training.
e) The present invention can be used to simulate a failure to eject malfunction during live fire training.
f) The present invention can be used to simulate a failure to feed malfunction during live fire training.
g) The present invention can be used to simulate a stove pipe malfunction during live fire training.
h) The present invention can be used to simulate a cartridge over bolt malfunction during live fire training.
i) The present invention does not limit the firearm operator or firearm instructor to unrealistically staging, outside of live fire training, complex malfunctions such as a double feed malfunction.
j) The present invention allows for variability of simulated malfunction type to increase realism during live fire malfunction resolution training.
k) During live fire training the present invention allows the user to, if the user so chooses, select a malfunction type the user wishes to simulate from several malfunction types which can be simulated.
l) During live fire training the present invention may be employed such that if a firearm operator uses an incorrect procedure to resolve a simulated firearm malfunction, a second malfunction of a different nature may immediately occur. This may be used to emphasize the importance of using the correct firearm malfunction resolution procedure during live fire malfunction resolution training.

BRIEF DESCRIPTION OF DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 3 depicts both the first malfunction selection feature 3 and second malfunction selection feature 4 and also depicts their interaction with a round of adjacent live ammunition represented by phantom line A and a firearm magazine wall as represented by phantom line B.

FIG. 4 depicts a void malfunction feature 2 and its interaction with a magazine feedlip represented by phantom line C.

FIG. 5 serves to illustrate a void malfunction feature 2.

FIG. 6 serves to illustrate a first malfunction selection feature 3 and a second malfunction selection feature 4.

FIG. 7 depicts the non-circular cross section of this embodiment of the Malfunction Training Dummy Round 1 and how it relates to the external shape of live ammunition represented by phantom lines D.

FIG. 11 depicts the Malfunction Training Dummy Round 1 locked into the magazine ejection malfunction orientation in a firearm magazine assembly 21 below ten rounds of live ammunition 37.

FIG. 12 depicts the Malfunction Training Dummy Round 1 locked into the magazine ejection malfunction orientation at the top of a firearm magazine assembly 21.

FIG. 13 depicts the Malfunction Training Dummy Round 1 locked into the magazine ejection malfunction orientation at the top of a firearm magazine assembly 21.

FIG. 14 depicts the Malfunction Training Dummy Round 1 in the process of ejecting from a firearm magazine assembly 21.

FIG. 15 depicts the Malfunction Training Dummy Round 1 having ejected from a firearm magazine assembly 21.

FIG. 16 depicts the Malfunction Training Dummy Round 1 having ejected from a firearm magazine assembly 21.

FIG. 17 depicts a simulated double feed firearm malfunction induced by the Malfunction Training Dummy Round 1.

FIG. 18 depicts one embodiment of the Malfunction Training Dummy Round 1 loaded inside the firearm magazine assembly 21 and locked into the bolt over base malfunction orientation below ten rounds of live ammunition 37.

FIG. 19 depicts the Malfunction Training Dummy Round 1 locked into the bolt over base malfunction orientation at the top of the firearm magazine assembly 21.

FIG. 20 depicts the Malfunction Training Dummy Round 1 locked into the bolt over base malfunction orientation at the top of the firearm magazine assembly 21.

FIG. 21 depicts a simulated bolt over base malfunction induced by the Malfunction Training Dummy Round 1.

FIG. 22 depicts the Malfunction Training Dummy Round 1 loaded inside the firearm magazine assembly 21 below live ammunition 37 and adjacent live ammunition 38.

FIG. 23 depicts the state of the Malfunction Training Dummy Round 1 in the failure to fire malfunction orientation at the top of the firearm magazine assembly 21.

FIG. 24 depicts the state of the Malfunction Training Dummy Round 1 in the failure to fire malfunction orientation at the top of the firearm magazine assembly 21.

FIG. 25 depicts a simulated failure to fire malfunction induced by the Malfunction Training Dummy Round 1.

FIG. 26 depicts a simulated failure to fire malfunction induced by the Malfunction Training Dummy Round 1 wherein the Malfunction Training Dummy Round 1 will be extracted from the firearm chamber 39.

FIG. 28 depicts a simulated failure to fire malfunction induced by the Malfunction Training Dummy Round 1 wherein the Malfunction Training Dummy Round 1 will not be extracted from the firearm chamber 39.

FIG. 30 depicts one of the possible variations of the failure to fire malfunction depicted in FIG. 25. In FIG. 30 the ejector 35 is depicted such that it has entered the void malfunction feature 2 of a particular embodiment of the Malfunction Training Dummy Round 1.

REFERENCE NUMERALS

1 Malfunction Training Dummy Round.
2 Void malfunction feature.
3 First malfunction selection feature.
4 Second malfunction selection feature.
5 Edge of the void malfunction feature.
6 Front center.
7 Rear center.
8 Rear surface.
9 Outer surface.
10 Extraction rim.
11 Malfunction selection feature width.
12 Malfunction selection feature depth.
13 Void malfunction feature width.
14 Void malfunction feature depth.
15 Angle between malfunction selection feature and void malfunction feature.
16 Center axis.
17 Firearm.
18 Forward portion of firearm.
19 Rearward portion of firearm.
20 Forward travel.
21 Firearm magazine assembly.
22 Front of magazine assembly.
23 Rear of magazine assembly.
24 Edge of the left magazine feedlip.
25 Edge of the right magazine feedlip.
26 Left magazine wall.
27 Right magazine wall.
28 Magazine follower.
29 Magazine spring.
30 Magazine floorplate.
31 Firearm bolt assembly.
32 Front of bolt assembly.
33 Rear of bolt assembly.
34 Bolt lug.
35 Ejector.
36 Extractor.
37 Live ammunition.
38 Adjacent live ammunition.
39 Firearm chamber.
40 Extractor width.
41 Void malfunction feature length.
42 Left magazine feedlip.
43 Right magazine feedlip.
44 Bottom of magazine assembly.
45 Upper portion of firearm.
46 Lower portion of firearm.
47 Rotation.
48 Magazine spring force.
49 Rearward travel.
50 Live ammunition to the right.
51 Live ammunition at left magazine feedlip.
52 Contact area.
53 Protrusion malfunction feature.
54 Inner portion of magazine feedlip.
55 Firearm receiver area.
56 Firearm magazine well.
57 Firearm magazine body.
58 Firearm extractor pin.
59 Firearm extractor spring.
60 Firearm bolt body.
61 Magazine wall force.
62 Magazine failure to feed selection feature.
63 Chamber failure to feed selection feature.
64 Failure to fire selection feature.
A Phantom line representation of adjacent live ammunition.
B Phantom line representation of firearm magazine wall.
C Phantom line representation of magazine feedlip.
D Phantom line representation of live ammunition.
E Phantom line representation of reciprocating firearm bolt assembly.
F Phantom line representation of extractor.
G Phantom line representation of ejector.

DETAILED DESCRIPTION OF DRAWINGS

The presently exemplary embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the apparatus, system, and method of the present invention, as represented in FIGS. 1 through 41, is not intended to limit the scope of the invention, as claimed, but is merely representative of presently exemplary embodiments of the invention.

Figure 1:
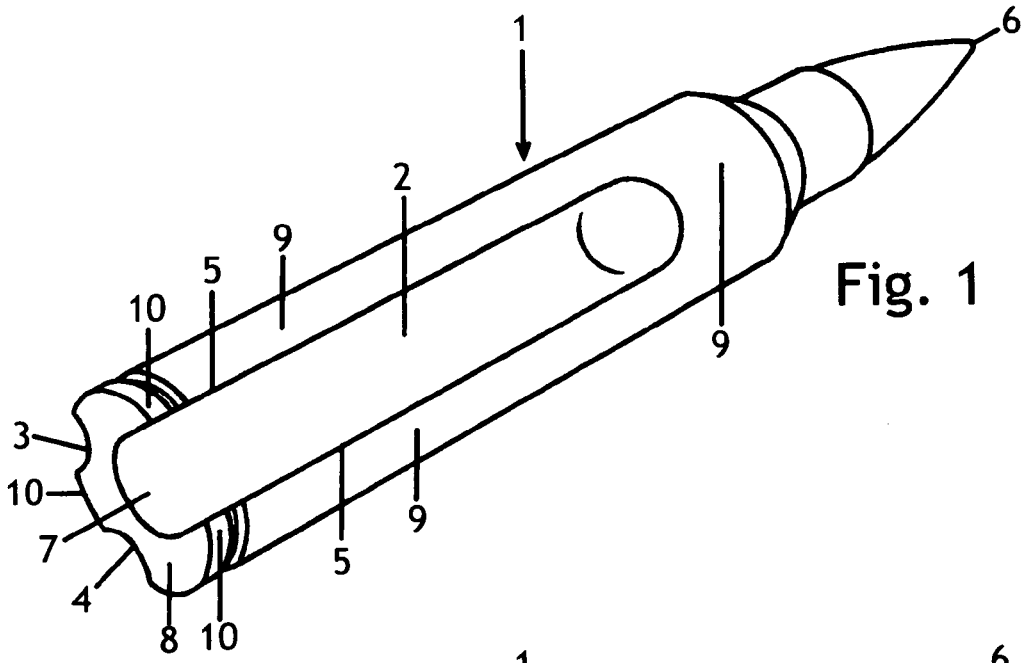
FIG. 1 is a perspective view of one embodiment of the Malfunction Training Dummy Round 1 oriented to highlight a void malfunction feature 2.

FIG. 1 is a perspective view of one embodiment of the Malfunction Training Dummy Round 1 oriented to highlight a void malfunction feature 2. In this embodiment, the void malfunction feature 2 comprises a void in a radial outer surface 9, an extraction rim 10 and a rear surface 8. The void malfunction feature 2 in this embodiment of the Malfunction Training Dummy Round 1 may induce a variety of simulated firearm malfunctions. In this embodiment the outer surface 9, rear surface 8, extraction rim 10, front center 6 and rear center 7 may be of similar exterior dimensions and arrangement as present on a live ammunition cartridge except as related to the void malfunction feature 2, a first malfunction selection feature 3 and a second malfunction selection feature 4.

Figure 2:
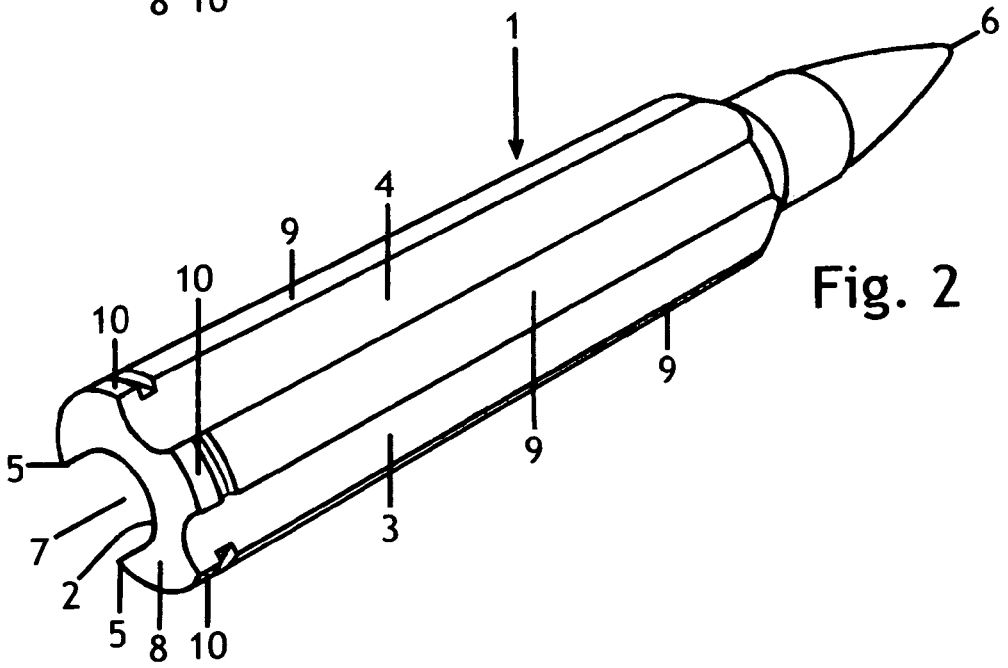
FIG. 2 is a perspective view of one embodiment of the Malfunction Training Dummy Round 1 oriented to highlight a first malfunction selection feature 3 and a second malfunction selection feature 4.

FIG. 2 is a perspective view of one embodiment of the Malfunction Training Dummy Round 1 oriented to highlight a first malfunction selection feature 3 and a second malfunction selection feature 4. In this embodiment, the first malfunction selection feature 3 and the second malfunction selection feature 4 comprise voids in a radial outer surface 9, an extraction rim 10 and a rear surface 8. The first malfunction selection feature 3 and the second malfunction selection feature 4 in this embodiment of the Malfunction Training Dummy Round 1 may induce desired orientations of the Malfunction Training Dummy Round 1 such that particular simulated firearm malfunction types occur.

Figure 3:
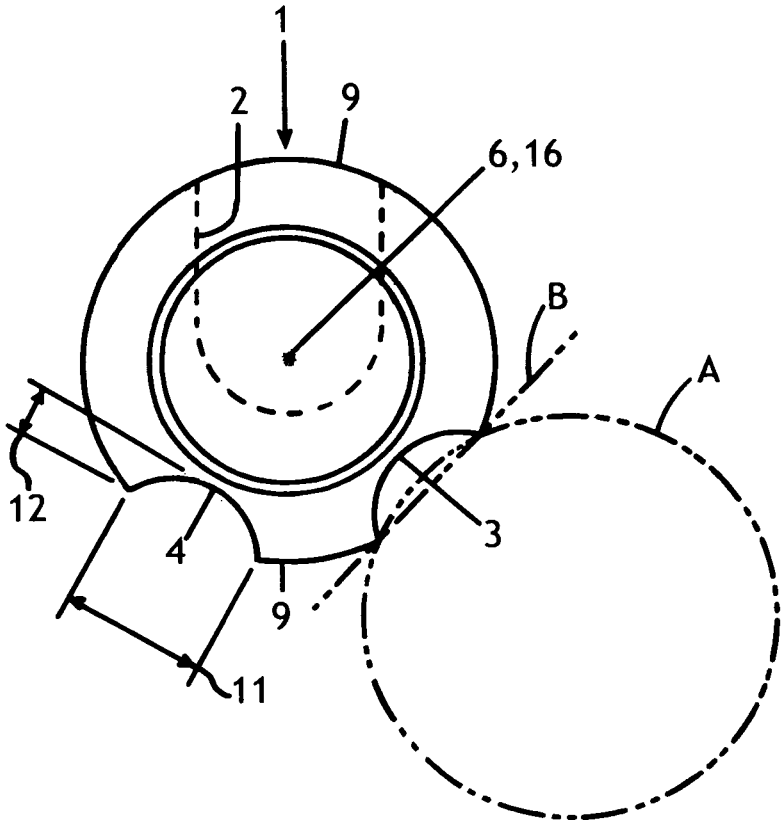
FIG. 3 is a front view of one embodiment of the Malfunction Training Dummy Round 1.

FIG. 3 is a front view of one embodiment of the Malfunction Training Dummy Round 1. FIG. 3 depicts a width 11 and depth 12 which are identical for both the first malfunction selection feature 3 and second malfunction selection feature 4. As demonstrated in FIG. 3, adjacent live ammunition represented by phantom line A may enter the first malfunction selection feature 3 or the second malfunction selection feature 4. This entrance of the adjacent live ammunition represented by phantom line A into the first malfunction selection feature 3 may prevent rotation of the Malfunction Training Dummy Round 1 about its center axis 16 while loaded in the firearm magazine assembly. Alternatively, the adjacent live ammunition represented by phantom line A may lock into the second malfunction feature 4. A firearm magazine wall as represented by phantom line B may also lock against the first malfunction selection feature 3 to prevent rotation of the Malfunction Training Dummy Round 1 about its center axis 16 while loaded in the firearm magazine assembly. Alternatively a firearm magazine wall as represented by phantom line B may lock against the second malfunction selection feature 4. In some exemplary embodiments, the quantity, shape, width 11 and depth 12 of the malfunction selection features may be modified to allow selection of varied malfunction types. In addition to their use in preventing rotation of the Malfunction Training Dummy Round 1, in some exemplary embodiments the malfunction selection features themselves may induce simulated firearm malfunctions.

Figure 4:
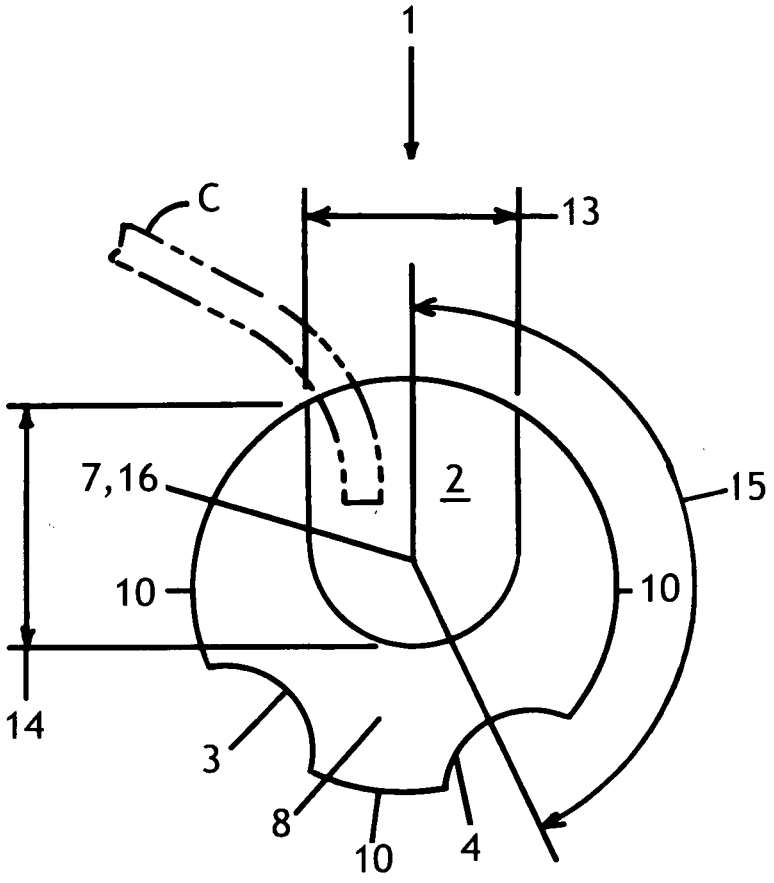
FIG. 4 is a rear view of one embodiment of the Malfunction Training Dummy Round 1.

FIG. 4 is a rear view of one embodiment of the Malfunction Training Dummy Round 1. FIG. 4 depicts a void malfunction feature 2 with width 13 and depth 14. The void malfunction feature width 13 and void malfunction feature depth 14 are such that various firearm parts or firearm magazine assembly parts may enter the void malfunction feature 2 such that the Malfunction Training Dummy Round 1 may cause various simulated firearm malfunctions. In the case shown in FIG. 4, for illustrative purposes, a magazine feedlip represented by phantom line C is depicted having entered the void malfunction feature 2. Such an interaction between a magazine feedlip and the void malfunction feature 2 may prevent the firearm magazine assembly from retaining the Malfunction Training Dummy Round 1 in the manner it would normally retain a live ammunition cartridge. The angle between the malfunction selection feature and the void malfunction feature 15 may be chosen such that when the second malfunction selection feature 4 interfaces with adjacent ammunition in the firearm magazine assembly, the void malfunction feature 2 is oriented such that various firearm parts will enter the void malfunction feature 2 to cause various firearm malfunctions. Said orientation of the void malfunction feature 2 may be maintained during loading of the firearm magazine assembly or firing of the firearm by the rotation prevention capabilities of the malfunction selection features.

Figure 5:
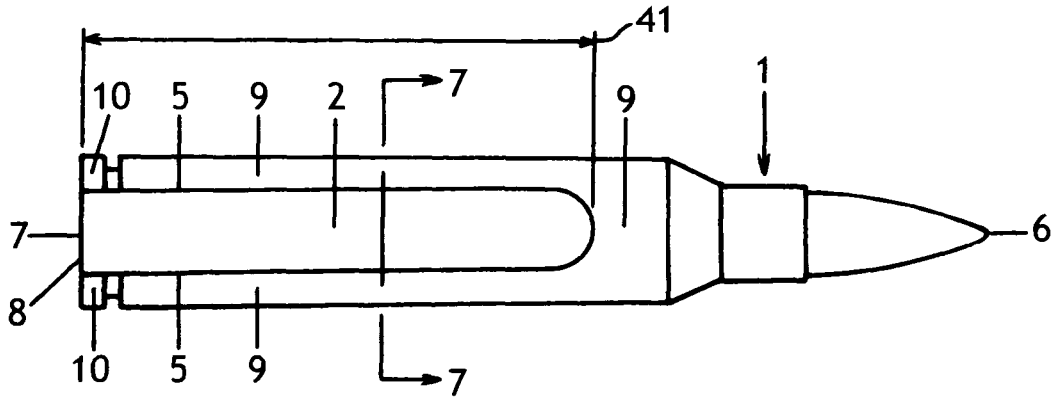
FIG. 5 is a side view of one embodiment of the Malfunction Training Dummy Round 1.

FIG. 5 is a side view of one embodiment of the Malfunction Training Dummy Round 1. FIG. 5 depicts the void malfunction feature 2 comprising a void in a radial outer surface 9, an extraction rim 10 and a rear surface 8. In this embodiment, the void malfunction feature 2 does not continue the entire length of the outer surface 9. Outer surface 9 is therefore uninterrupted in front of the void malfunction feature 2. This uninterrupted portion of outer surface 9 in front of the void malfunction feature 2 may prevent the void malfunction feature 2 from interacting with adjacent live ammunition, the firearm magazine or firearm in such a way that the Malfunction Training Dummy Round 1 would be rotated from its desired orientation. The void malfunction feature length 41 is chosen such that the feedlip of the firearm magazine assembly may enter the void malfunction feature 2. The void malfunction feature length 41 differs in some exemplary embodiments. Please note FIG. 7 sectional reference lines.

Figure 6:
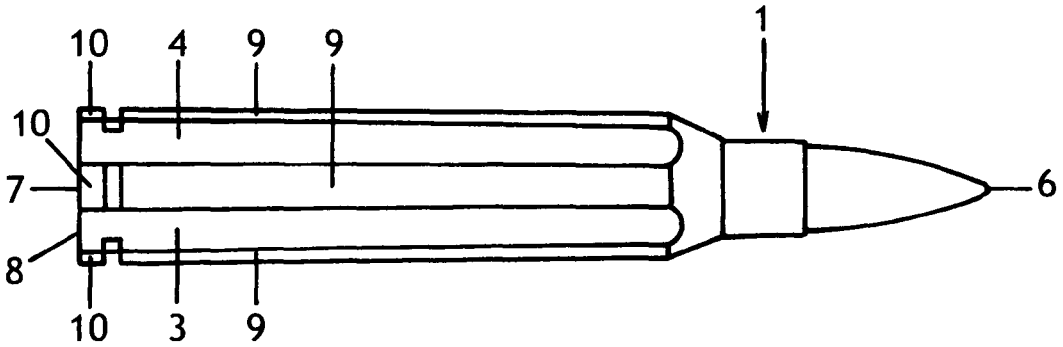
FIG. 6 is a side view of one embodiment of the Malfunction Training Dummy Round 1.

FIG. 6 is a side view of one embodiment of the Malfunction Training Dummy Round 1. FIG. 6 depicts first malfunction selection feature 3 and second malfunction selection feature 4 running across the outer surface 9. In this embodiment, the first malfunction selection feature 3 and second malfunction selection feature 4 run the full length of the outer surface 9. In part because the first malfunction selection feature 3 and second malfunction selection feature 4 are full length, either may act to prevent the rotation of the Malfunction Training Dummy Round 1 from its desired orientation.

Figure 7:
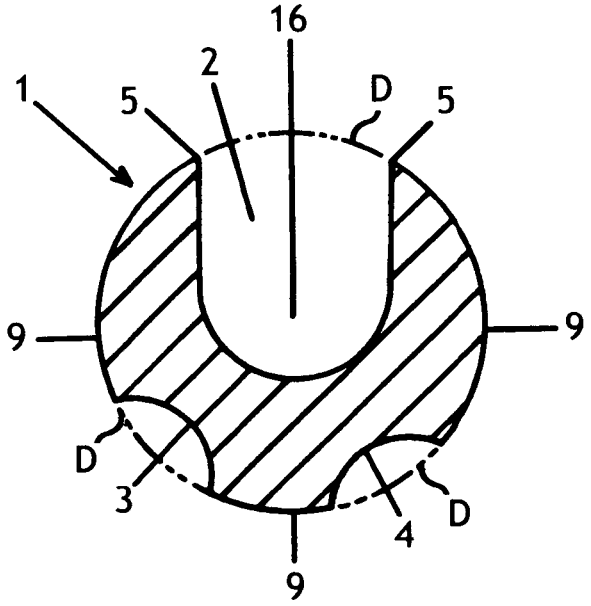
FIG. 7 is a rear cross sectional view of one embodiment of the Malfunction Training Dummy Round 1.

FIG. 7 is a rear cross sectional view of one embodiment of the Malfunction Training Dummy Round 1. FIG. 7 depicts the non-circular cross section of this embodiment of the Malfunction Training Dummy Round 1. The void malfunction feature 2, first malfunction selection features 3 and second malfunction selection feature 4 may each create a void section which differs from the external shape of live ammunition represented by phantom lines D.

Figure 8:
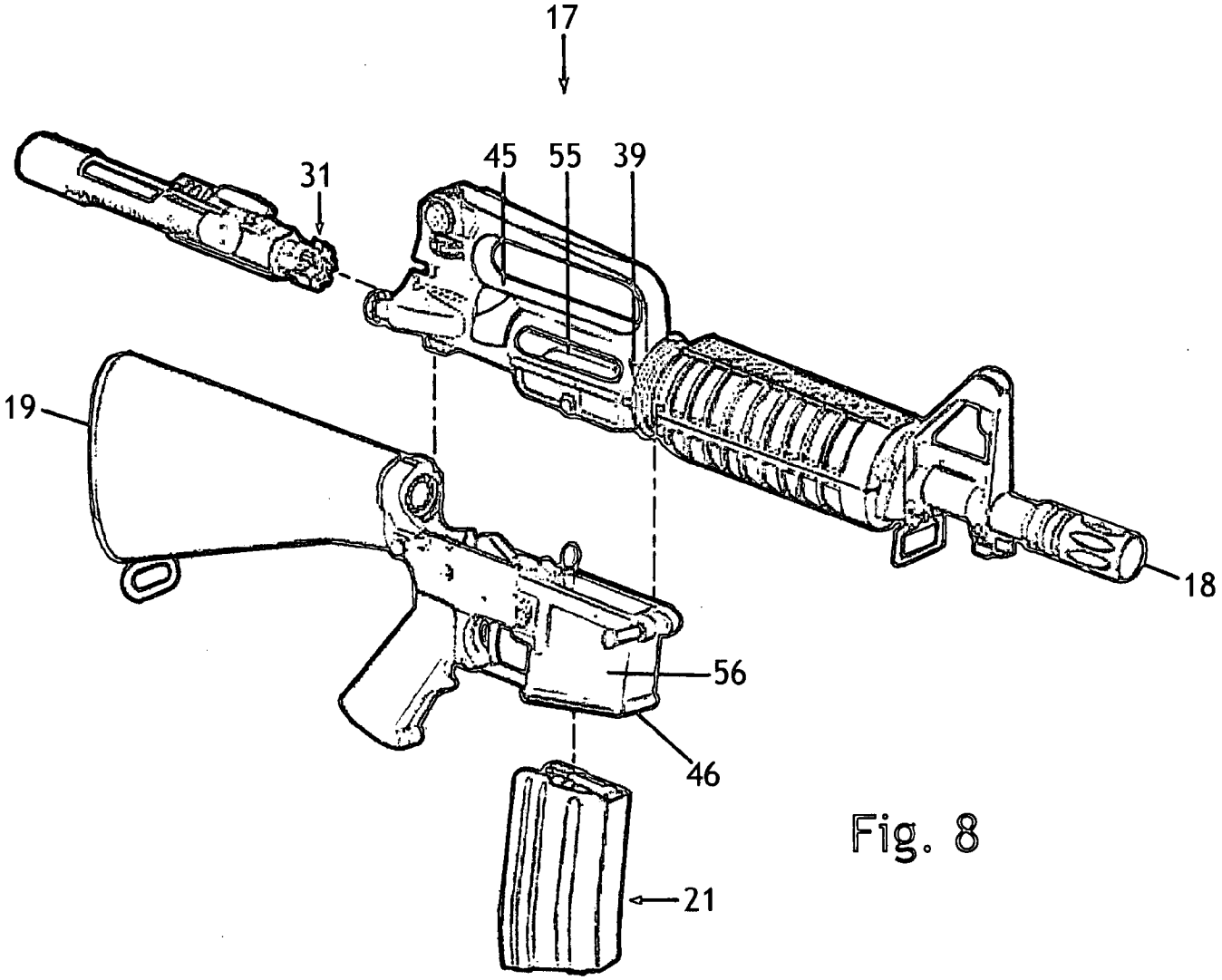
FIG. 8 is an exploded view of a firearm 17 illustrative of one type of firearm known to the art.

FIG. 8 is an exploded view of a firearm 17 illustrative of one type of firearm known to the art. FIG. 8 depicts a forward portion of firearm 18, rearward portion of firearm 19, upper portion of firearm 45 and lower portion of firearm 46. Also depicted are a firearm bolt assembly 31, firearm magazine assembly 21, firearm receiver area 55, firearm chamber 39 and firearm magazine well 56. While the firearm 17 depicted in FIG. 8 is illustrative of one type of firearm for which the Malfunction Training Dummy Round 1 may be used to simulate malfunctions, there are many other firearm types and other firearm models for which the Malfunction Training Dummy Round 1 may be used with including but not limited to rifles, shotguns, handguns and submachine guns.

Figure 9:
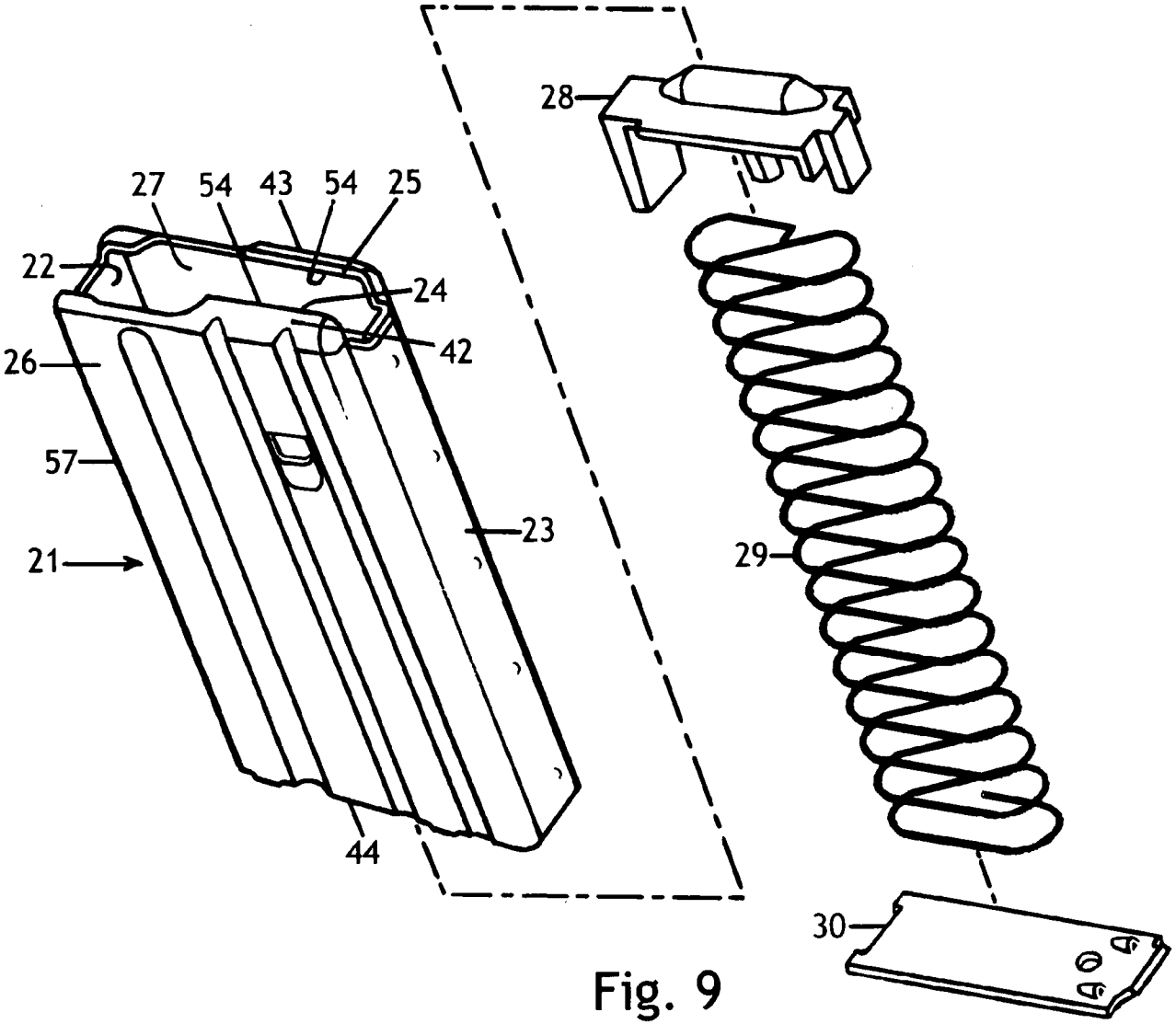
FIG. 9 is an exploded view of a firearm magazine assembly 21 illustrative of one type of firearm magazine known to the art.

FIG. 9 is an exploded view of a firearm magazine assembly 21 illustrative of one type of firearm magazine known to the art. The firearm magazine assembly 21 in FIG. 8 is shown in its four major components, a firearm magazine body 57, a magazine follower 28, a magazine spring 29 and a magazine floorplate 30. Also depicted are left magazine feedlip 42, right magazine feedlip 43, edge of the left magazine feedlip 24, edge of right magazine feedlip 25, inner portion of magazine feedlip 54, front of magazine assembly 22, rear of magazine assembly 23, left magazine wall 26, right magazine wall 27 and bottom of magazine 44. While the firearm magazine assembly 21 depicted in FIG. 9 is illustrative of one type of firearm magazine for which the Malfunction Training Dummy Round 1 may be used to simulate malfunctions, there are many other firearm magazine types and other firearm ammunition delivery methods with which the Malfunction Training Dummy Round 1 may be used, including but not limited to firearm magazine assemblies of metal construction, firearm magazine assemblies of polymer construction, single stack firearm magazines, double stack firearm magazines, triple stack firearm magazines, quadruple stack firearm magazines, tubular firearm magazines, spiral firearm magazines, single feedlip firearm magazines, double feedlip firearm magazines, detachable firearm magazines, integral firearm magazines, ammunition links, ammunition belts, ammunition feeding trays, ammunition clips, ammunition en-block clips and ammunition link-less feed systems.

Figure 10:
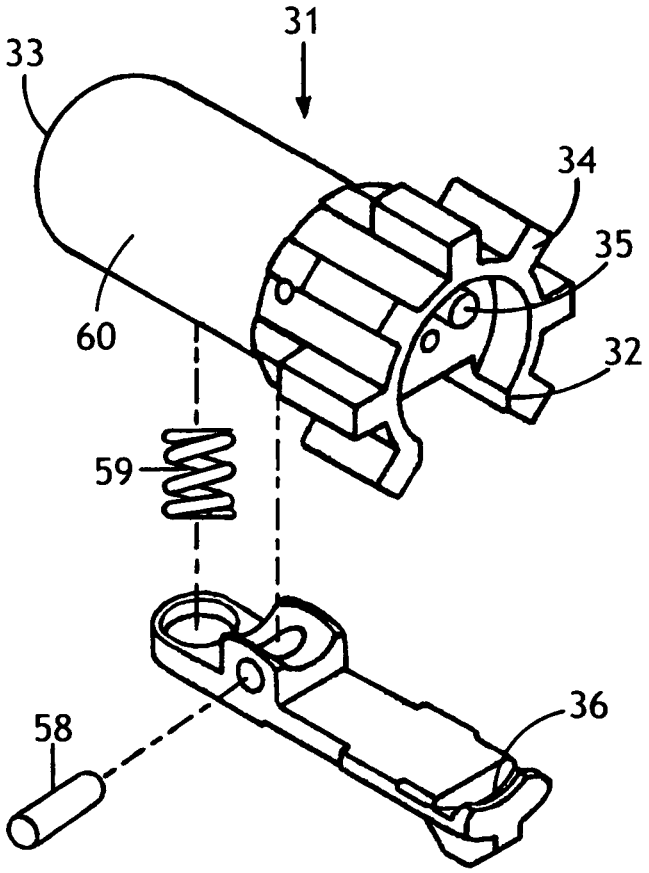
FIG. 10 is an exploded view of a firearm bolt assembly 31 illustrative of a firearm bolt known to the art.

FIG. 10 is an exploded view of a firearm bolt assembly 31 illustrative of a firearm bolt known to the art. The firearm bolt assembly 31 in FIG. 10 is shown in four major components, a firearm bolt body 60, an extractor 36, an extractor pin 58 and an extractor spring 59. The extractor 36 typically serves to lock onto the extraction rim found on an ammunition cartridge to facilitate the extraction of ammunition from the firearm chamber. An ejector 35, shown as a member of the bolt body 60, typically serves to apply force a rear surface of an ammunition cartridge to facilitate its ejection from the firearm. A bolt lug 34 is shown which, among other purposes, serves to strip an ammunition cartridge from the firearm magazine assembly. After an ammunition cartridge is stripped from the firearm magazine assembly 21, the front of bolt assembly 32 serves to apply force to the ammunition cartridge such that it will be fed into the firearm chamber 39. While the firearm bolt assembly 31 depicted in FIG. 10 is illustrative of one type of firearm bolt for which the Malfunction Training Dummy Round 1 may be used to simulate malfunctions, there are many other firearm bolt types and other ammunition extraction, ammunition ejection and ammunition feeding methods with which the Malfunction Training Dummy Round 1 may be used, including but not limited to ejectors that are fixed to a portion of the firearm other than the bolt, ejectors which are non-fixed parts within the firearm, monolithic extractors and immobile bolts.

Figure 11:
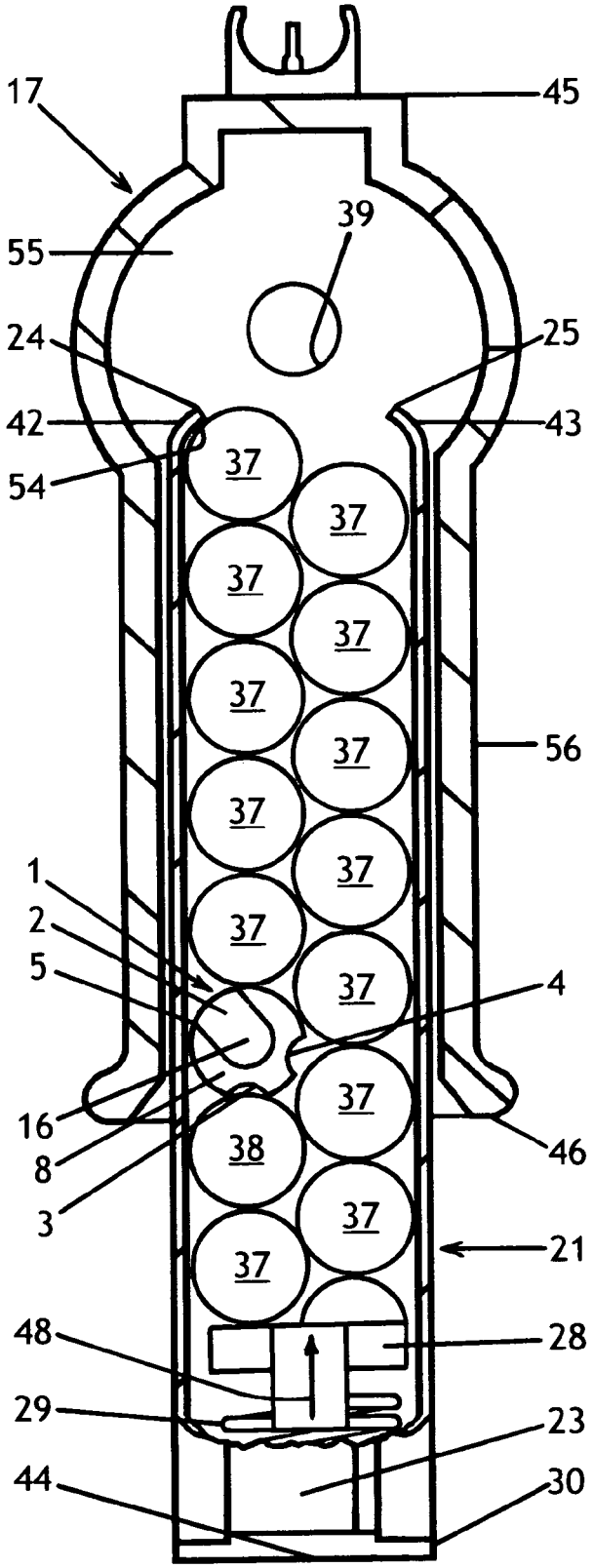
FIG. 11 is a rear partial sectional view of a firearm magazine assembly 21 locked into the magazine well 56 of a firearm 17.
Figure 17:
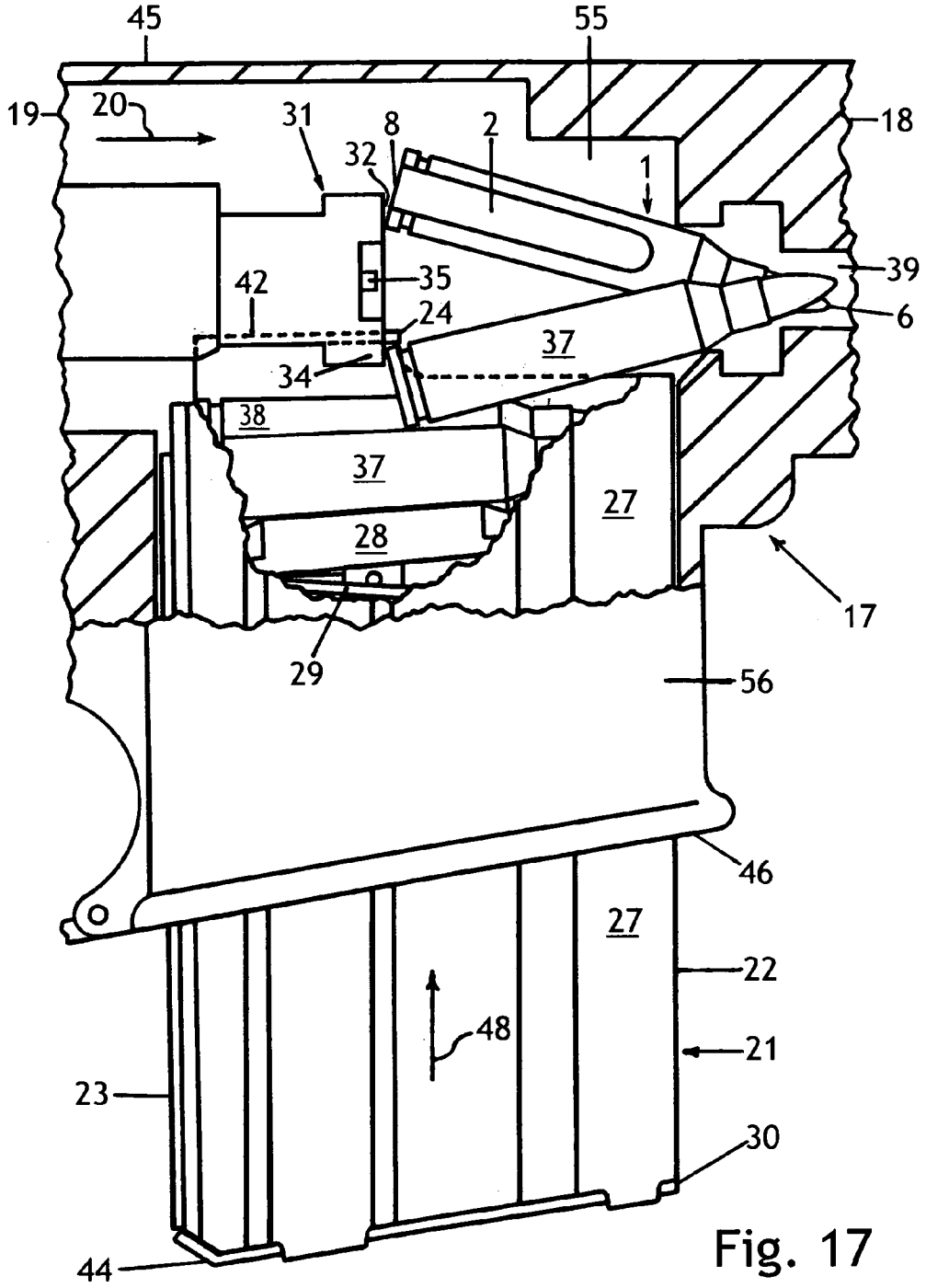
FIG. 17 is a right side partial sectional view of the firearm magazine assembly 21 locked into the magazine well 56 of a firearm 17.

FIG. 11 is a rear partial sectional view of a firearm magazine assembly 21 locked into the magazine well 56 of a firearm 17. FIG. 11 depicts the Malfunction Training Dummy Round 1 as loaded inside the firearm magazine assembly 21 and locked into the magazine ejection malfunction orientation. The depicted magazine ejection malfunction orientation is such that the Malfunction Training Dummy Round 1 will eject from the firearm magazine assembly 21 into the firearm receiver area 55 after the live ammunition 37 above is fired. This ejection will cause one of several magazine ejection malfunction types, including but not limited to the simulated double feed firearm malfunction as seen in FIG. 17. As depicted in FIG. 11, the magazine ejection malfunction orientation is such that the void malfunction feature 2 of the Malfunction Training Dummy Round 1 is oriented toward the edge of left magazine feedlip 24. When in this magazine ejection malfunction orientation, adjacent live ammunition 38 enters the first malfunction selection feature 3 by magazine spring force 48. Therefore adjacent live ammunition 38 acts as a spring loaded detent to prevent rotation of the Malfunction Training Dummy Round 1 about its center axis 16 during both the loading of the firearm magazine assembly 21 and firing of the firearm 17. By this interaction of the first malfunction selection feature 3 and adjacent live ammunition 38, the Malfunction Training Dummy Round 1 will remain in the depicted magazine ejection malfunction orientation as the ten rounds of live ammunition 37 above the Malfunction Training Dummy Round 1 are fired by the firearm 17. The conditions depicted in FIG. 11 may be achieved in one of two ways. The firearm operator may choose to train on simulated magazine ejection malfunctions, utilizing the first malfunction selection feature 3 to lock the Malfunction Training Dummy Round 1 into the magazine ejection malfunction orientation as he or she loads it into the firearm magazine assembly 21. If this option is chosen, the firearm operator will have prior knowledge that a simulated magazine ejection malfunction will occur upon firing the firearm 17. Alternatively, the firearm operator may choose to load the Malfunction Training Dummy Round 1 into the firearm magazine assembly 21 without giving regard as to its orientation. This may result in the Malfunction Training Dummy Round 1 locking into the position depicted in FIG. 11 without the firearm operator having prior knowledge that a simulated magazine ejection malfunction will occur upon firing the firearm 17. The following steps are performed in order to load a firearm magazine assembly 21 with the Malfunction Training Dummy Round 1 in the magazine ejection malfunction orientation as seen in FIG. 11. Starting with a firearm magazine assembly 21 partially loaded with live ammunition 37, the firearm operator inserts the Malfunction Training Dummy Round 1 underneath the left magazine feedlip 42 of the firearm magazine assembly 21. While inserting the Malfunction Training Dummy Round 1 underneath the left magazine feedlip 42, the firearm operator orients the void malfunction feature 2 towards the edge of the left magazine feedlip 24. When the void malfunction feature 2 is oriented such that the depicted magazine ejection malfunction orientation is achieved, adjacent live ammunition 38 enters the first malfunction selection feature 3, locking its orientation by upward spring force 48. The firearm operator then loads ten rounds of live ammunition 37 above the Malfunction Training Dummy Round 1. The firearm magazine assembly 21, now loaded with live ammunition 37 and the Malfunction Training Dummy Round 1, is inserted into the magazine well 56 of the firearm 17 as is depicted in FIG. 11. The quantity of live ammunition 37 loaded above and below the Malfunction Training Dummy Round 1 may be varied by the firearm operator. Alternatively, the Malfunction Training Dummy Round 1 may be used to simulate magazine ejection malfunctions from the right magazine feedlip 43 with all steps and orientations mirror imaged.

Figure 12:
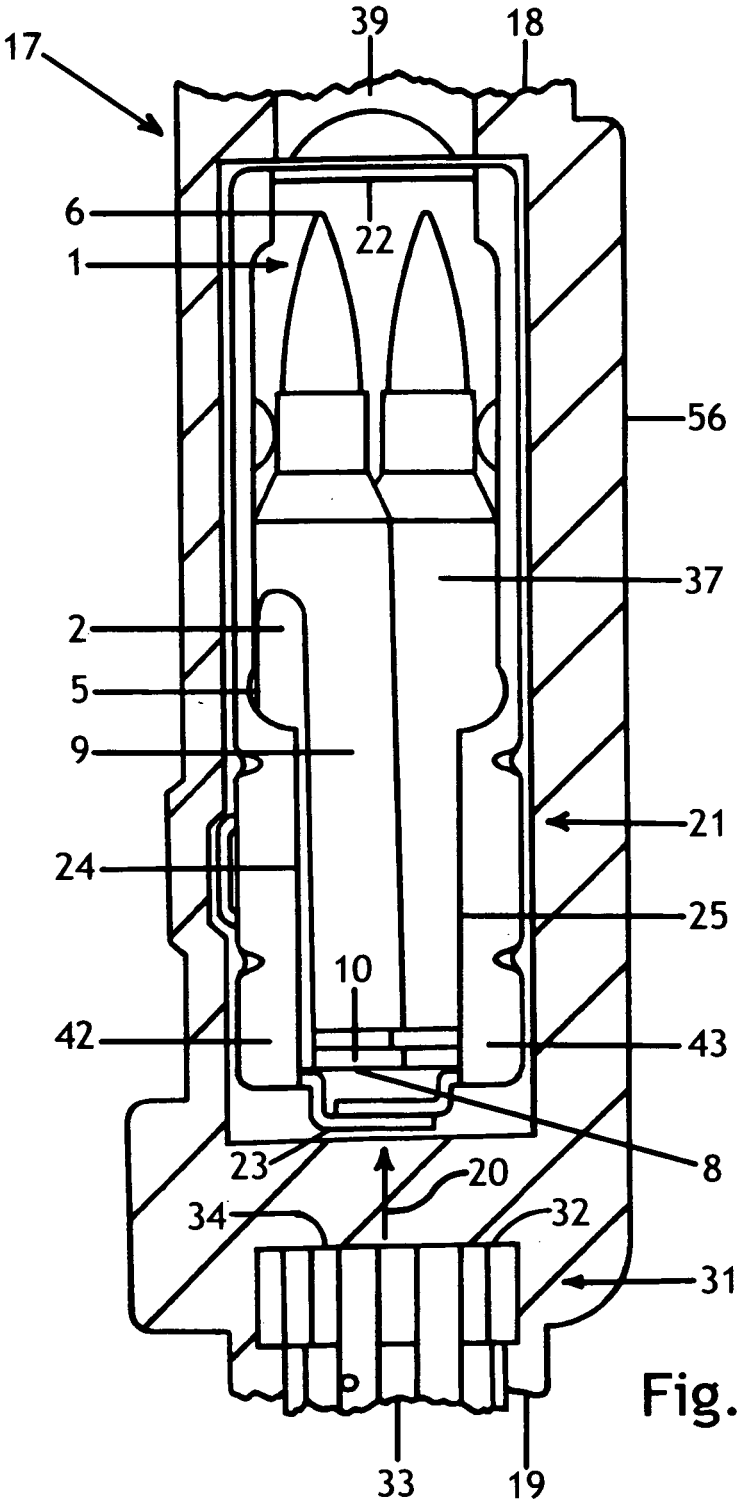
FIG. 12 is a top partial sectional view of the firearm magazine assembly 21 locked into the magazine well 56 of a firearm 17.
Figure 13:
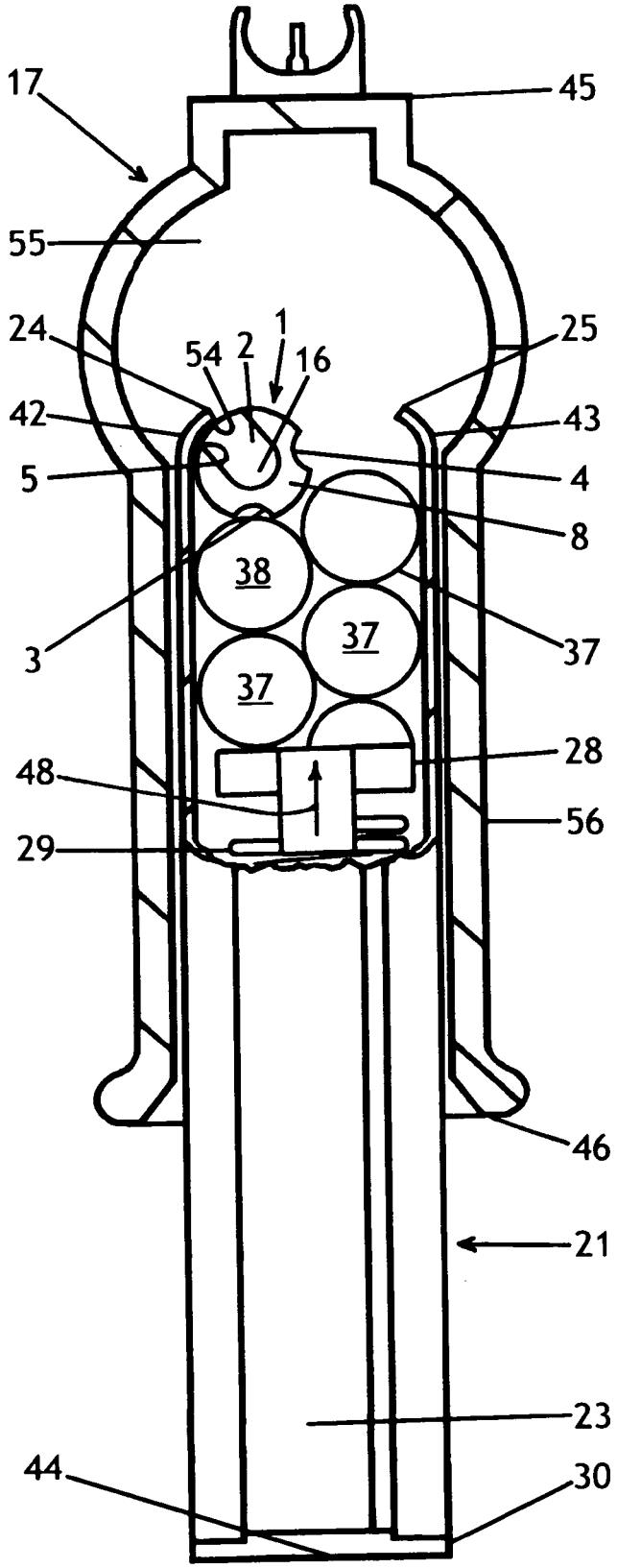
FIG. 13 is a rear partial sectional view of the firearm magazine assembly 21 locked into the magazine well 56 of a firearm 17.

FIG. 12 is a top partial sectional view of the firearm magazine assembly 21 locked into the magazine well 56 of a firearm 17. As also depicted in FIG. 13, FIG. 12 takes place immediately after the conditions depicted in FIG. 11. FIG. 12 depicts the state of the Malfunction Training Dummy Round 1 after the ten rounds of live ammunition 37 seen above the Malfunction Training Dummy Round 1 in FIG. 11 have been fired. FIG. 12 depicts the Malfunction Training Dummy Round 1 as having maintained its magazine ejection malfunction orientation, as depicted in FIG. 11, despite having traveled vertically towards the left magazine feedlip 42. As depicted in FIG. 11, FIG. 12 and FIG. 13, magazine ejection malfunction orientation is such that the void malfunction feature 2 of the Malfunction Training Dummy Round 1 is oriented toward the edge of the left magazine feedlip 24. As seen particularly well from this top view, in the magazine ejection malfunction orientation the void malfunction feature 2 aligns vertically with the edge of the left magazine feedlip 24.

FIG. 13 is a rear partial sectional view of the firearm magazine assembly 21 locked into the magazine well 56 of a firearm 17. As also depicted in FIG. 12, FIG. 13 takes place immediately after the conditions depicted in FIG. 11, FIG. 13 depicts the state of the Malfunction Training Dummy Round 1 after the ten rounds of live ammunition 37 seen above the Malfunction Training Dummy Round 1 in FIG. 11 have been fired. FIG. 13 depicts the Malfunction Training Dummy Round 1 as having maintained its magazine ejection malfunction orientation, as depicted in FIG. 11, despite having traveled vertically towards the left magazine feedlip 42. As depicted in FIG. 11, FIG. 12 and FIG. 13, magazine ejection malfunction orientation is such that the void malfunction feature 2 of the Malfunction Training Dummy Round 1 is oriented toward the edge of the left magazine feedlip 24. Magazine ejection malfunction orientation was maintained due to the entrance of adjacent live ammunition 38 into the first malfunction selection feature 3 by magazine spring force 48. Therefore, adjacent live ammunition 38 has acted as a spring loaded detent, preventing rotation of the Malfunction Training Dummy Round 1 about its center axis 16. This detent action prevented the Malfunction Training Dummy Round 1 from rotating out of the depicted magazine ejection malfunction orientation about its center axis 16 during firing of the firearm 17. Therefore, the Malfunction Training Dummy Round 1 has remained in the depicted magazine ejection malfunction orientation as the ten rounds of live ammunition 37 above the Malfunction Training Dummy Round 1, as seen in FIG. 11, were fired by the firearm 17. As depicted in FIG. 13, the magazine spring 29 is imparting an upward magazine spring force 48 upon the Malfunction Training Dummy Round 1. Because of this upward magazine spring force 48, the edge of void malfunction feature 5 of the Malfunction Training Dummy Round 1 has impacted the inner portion of magazine feedlip 54. Because the interaction between the edge of void malfunction feature 5 and the inner portion of the magazine feedlip 54 is to the left of the center axis 16, a torque is imparted upon the Malfunction Training Dummy Round 1 which will cause its rotation as seen in FIG. 14.

Figure 14:
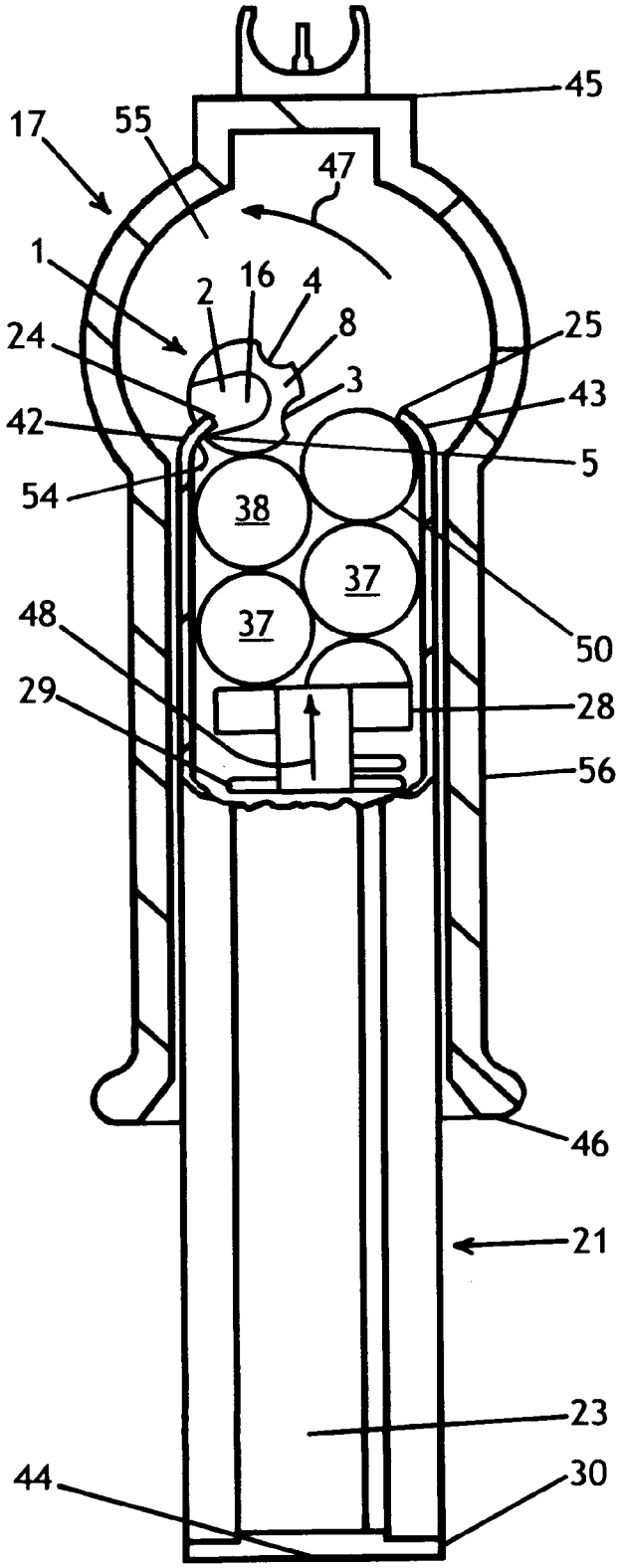
FIG. 14 is a rear partial sectional view of the firearm magazine assembly 21 locked into the magazine well 56 of a firearm 17.
Figure 15:
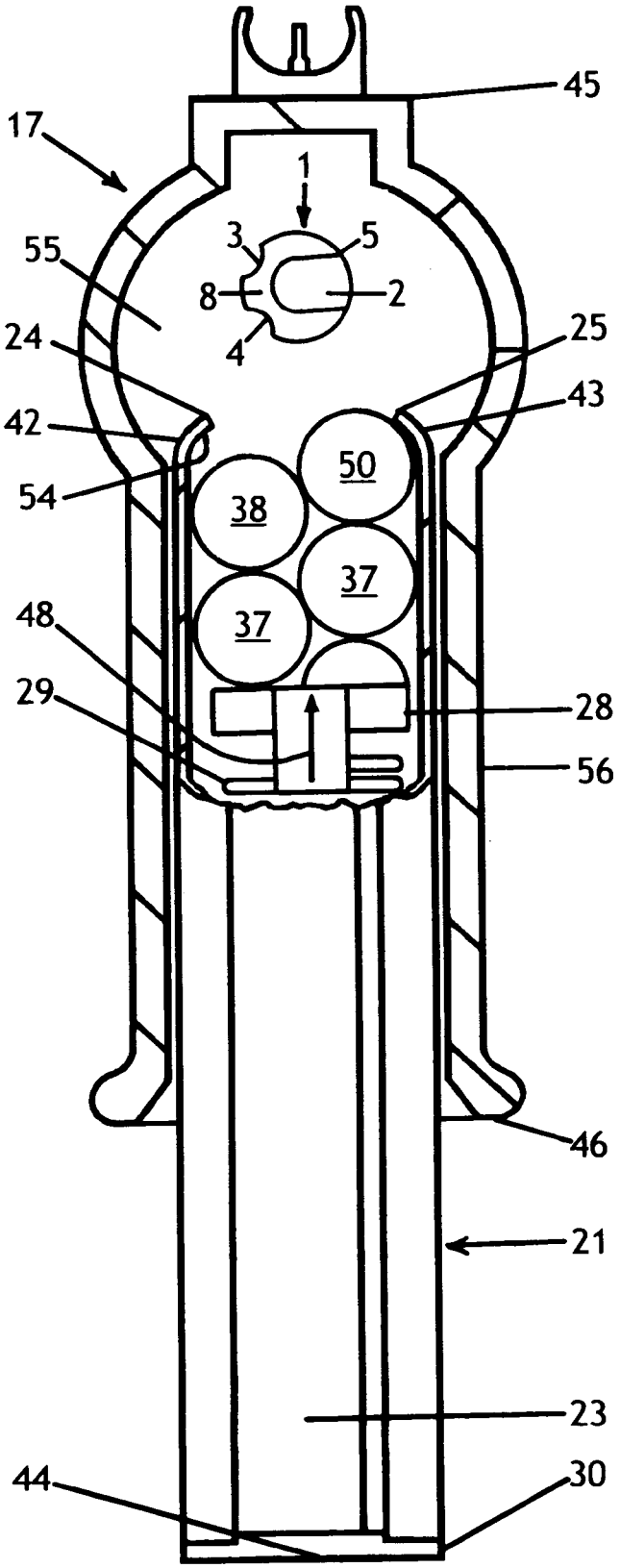
FIG. 15 is a rear partial sectional view of the firearm magazine assembly 21 locked into the magazine well 56 of a firearm 17.
Figure 16:
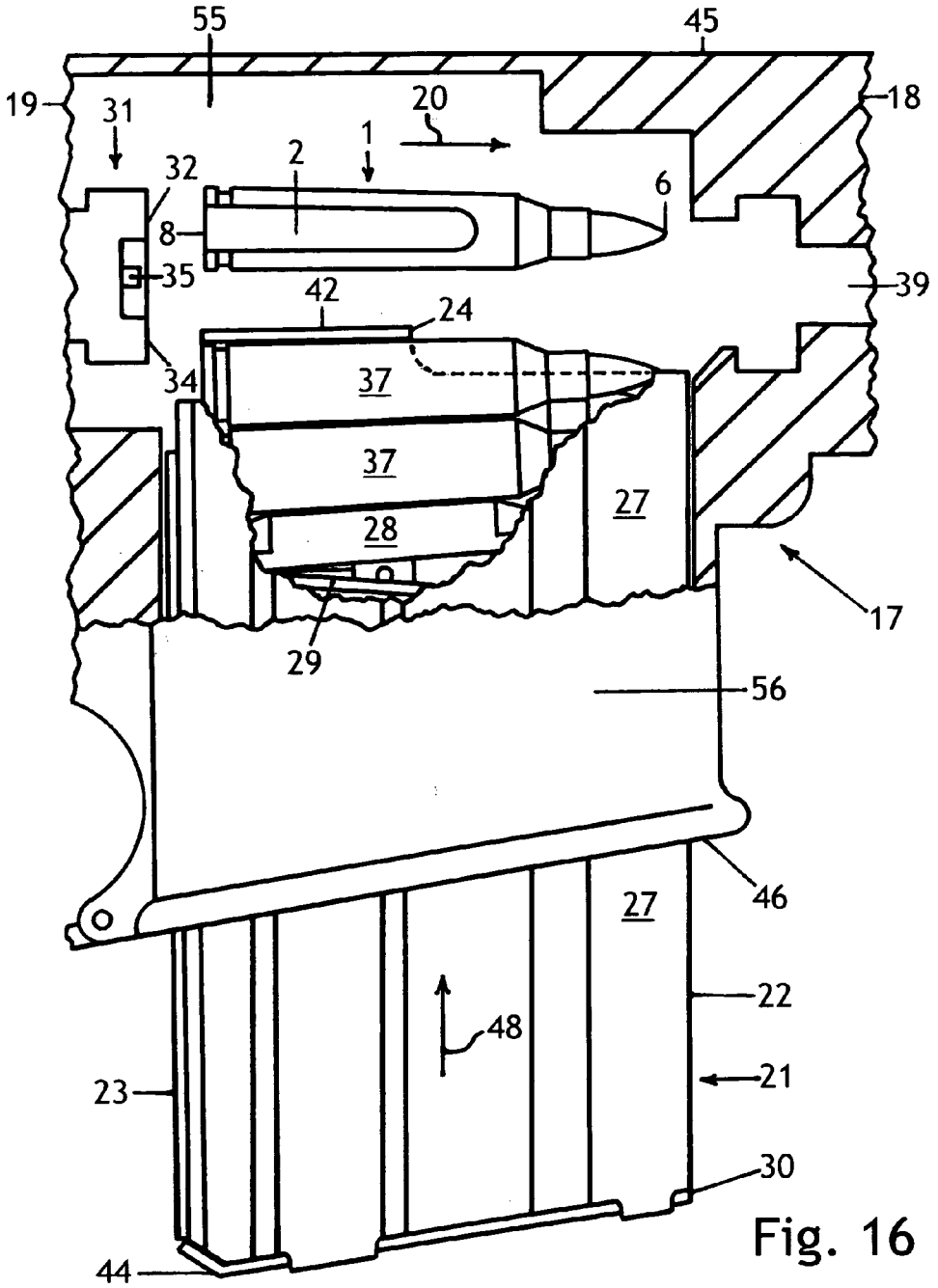
FIG. 16 is a right side partial sectional view of the firearm magazine assembly 21 locked into the magazine well 56 of a firearm 17.

FIG. 14 is a rear partial sectional view of the firearm magazine assembly 21 locked into the magazine well 56 of a firearm 17. Taking place immediately after the conditions depicted in FIG. 12 and FIG. 13, FIG. 14 depicts the state of the Malfunction Training Dummy Round 1 after the edge of void malfunction feature 5 impacts the inner portion of the magazine feedlip 54. As depicted in FIG. 14, the magazine spring 29 is imparting an upward magazine spring force 48 upon the Malfunction Training Dummy Round 1. Because of this upward magazine spring force 48, the edge of the void malfunction feature 5 of the Malfunction Training Dummy Round 1 has impacted the inner portion of magazine feedlip 54. Because the interaction between the edge of the void malfunction feature 5 and the inner portion of magazine feedlip 54 is to the left of the center axis 16, a torque is imparted upon the Malfunction Training Dummy Round 1 which causes its rotation 47. As the Malfunction Training Dummy Round 1 rotates, the edge of the left magazine feedlip 24 is forced into the void malfunction feature 2. Because the edge of the left magazine feedlip 24 enters void malfunction feature 2, the Malfunction Training Dummy Round 1 is able to eject from the firearm magazine assembly 21 and into the firearm receiver area 55 by upward spring force 48 as seen in FIG. 15 and FIG. 16. However, the distance that the Malfunction Training Dummy Round 1 is ejected into the firearm receiver area 55 may differ depending upon a variety of factors, including the type of firearm magazine assembly 21 used, as well as the quantity of live ammunition 37 loaded below the Malfunction Training Dummy Round 1. Even with weak ejection or no ejection from the firearm magazine assembly 21, the Malfunction Training Dummy Round 1 may still induce simulated firearm malfunctions. Even if the Malfunction Training Dummy Round 1 ejects no further into the firearm receiver area 55 than shown in the case of FIG. 14, a simulated double feed malfunction similar to that seen in FIG. 17 will be induced because the live ammunition to the right 50 of the Malfunction Training Dummy Round 1 is contacting the right magazine feedlip 43. Therefore any presence of the Malfunction Training Dummy Round 1 above the firearm magazine assembly 21 should be considered within the scope of the present invention.

FIG. 15 is a rear partial sectional view of the firearm magazine assembly 21 locked into the magazine well 56 of a firearm 17. As also depicted in FIG. 16, FIG. 15 takes place immediately after the conditions depicted in FIG. 14, FIG. 15 depicts the state of the Malfunction Training Dummy Round 1 after it fully ejects from the firearm magazine assembly 21 by upward spring force 48. After ejecting from the firearm magazine assembly 21, the Malfunction Training Dummy Round 1 enters the firearm receiver area 55. This ejection may cause one of several magazine ejection malfunction types, including but not limited to the simulated double feed firearm malfunction as depicted in FIG. 17. The depicted ejection of the Malfunction Training Dummy Round 1 from the firearm magazine assembly 21 may induce a number of magazine ejection malfunction types other than the double feed malfunction, including cartridge over bolt firearm malfunctions.

FIG. 16 is a right side partial sectional view of the firearm magazine assembly 21 locked into the magazine well 56 of a firearm 17. As also depicted in FIG. 15, FIG. 16 takes place immediately after the conditions depicted in FIG. 14. FIG. 16 depicts the state of the Malfunction Training Dummy Round 1 after its full ejection from the firearm magazine assembly 21 by upward spring force 48. Ejecting from the firearm magazine assembly 21, the Malfunction Training Dummy Round 1 enters the firearm receiver area 55. Upon bolt assembly 31 travel in the forward direction 20, one of several magazine ejection malfunction types will occur, including but not limited to the simulated double feed firearm malfunction as depicted in FIG. 17. The depicted ejection of the Malfunction Training Dummy Round 1 from the firearm magazine assembly 21 may induce a number of magazine ejection malfunction types other than the double feed malfunction, including cartridge over bolt firearm malfunctions.

FIG. 17 is a right side partial sectional view of the firearm magazine assembly 21 locked into the magazine well 56 of a firearm 17. Taking place immediately after the conditions depicted in FIG. 15 and FIG. 16, FIG. 17 depicts a simulated double feed firearm malfunction induced by the Malfunction Training Dummy Round 1. A simulated double feed malfunction may occur when the Malfunction Training Dummy Round 1 is ejected from the firearm magazine assembly 21 as seen in FIG. 15 and FIG. 16. When the firearm bolt assembly 31 travels in the forward direction 20, the front of bolt 32 strikes the rear surface 8 of the Malfunction Training Dummy Round 1 and attempts to load it into the firearm chamber 39. Simultaneously, the bolt lug 34 attempts to load live ammunition 37 from the firearm magazine assembly 21 into the firearm chamber 39. Because both the Malfunction Training Dummy Round 1 and live ammunition 37 cannot simultaneously load into the firearm chamber 39, the firearm bolt assembly 31 halts forward movement 20 and the firearm 17 binds into the depicted simulated double feed malfunction condition.

Figure 18:
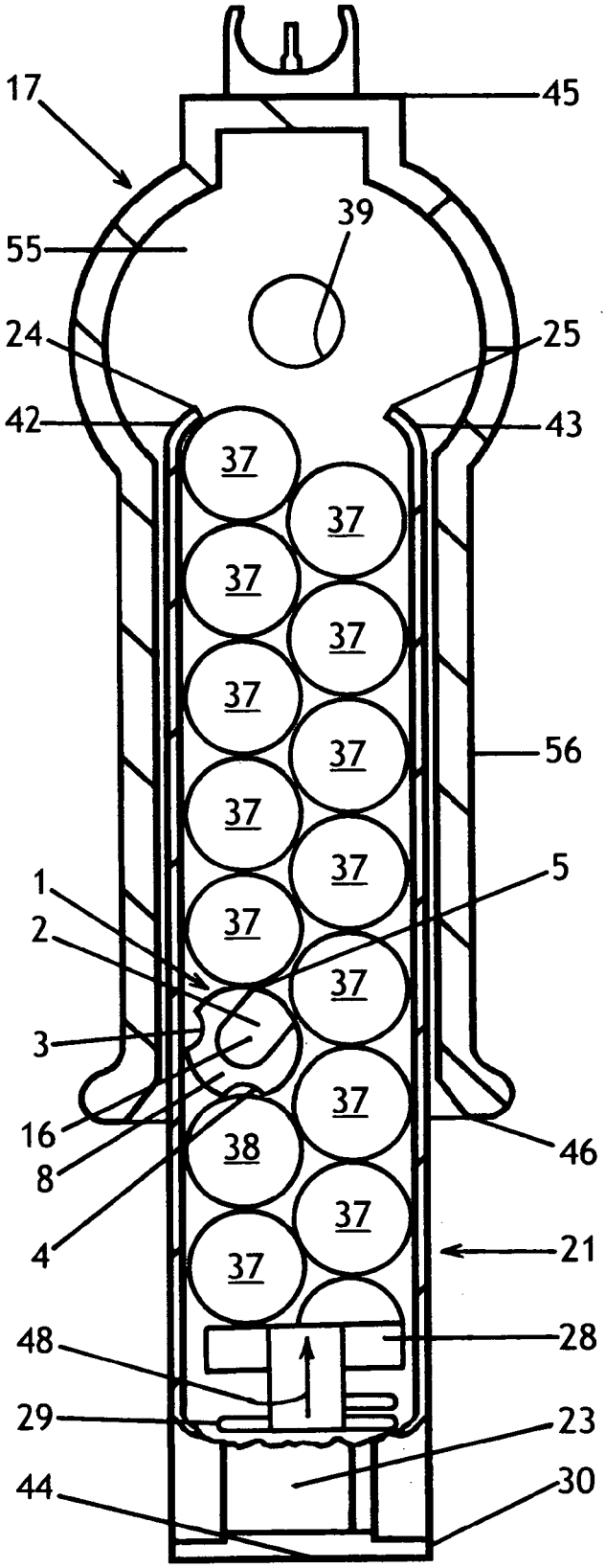
FIG. 18 is a rear partial sectional view of a firearm magazine assembly 21 locked into the magazine well 56 of a firearm 17.
Figure 21:
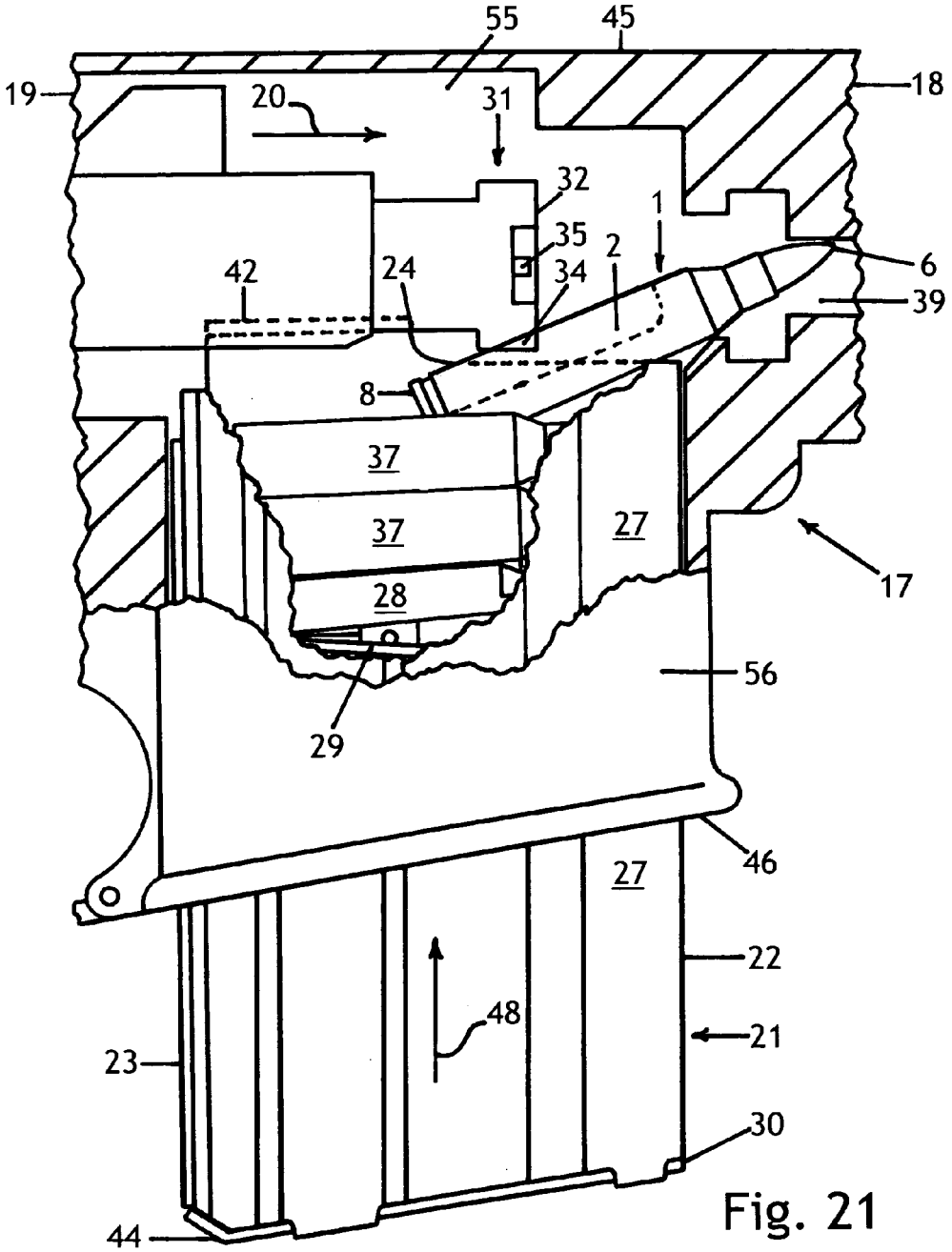
FIG. 21 is a right side partial sectional view of the firearm magazine assembly 21 locked into the magazine well 56 of a firearm 17.

FIG. 18 is a rear partial sectional view of a firearm magazine assembly 21 locked into the magazine well 56 of a firearm 17. FIG. 18 depicts one embodiment of the Malfunction Training Dummy Round 1 as loaded inside the firearm magazine assembly 21 and locked into the bolt over base malfunction orientation. The depicted bolt over base malfunction orientation is such that the Malfunction Training Dummy Round 1 may cause a simulated bolt over base firearm malfunction, as seen in FIG. 21, after the live ammunition 37 above is fired. As depicted in FIG. 18, the bolt over base malfunction orientation is such that the void malfunction feature 2 of the Malfunction Training Dummy Round 1 is oriented away from the edge of the left magazine feedlip 24. When in this bolt over base malfunction orientation, adjacent live ammunition 38 enters the second malfunction selection feature 4 by upward magazine spring force 48. Therefore, adjacent live ammunition 38 acts as a spring loaded detent preventing rotation of the Malfunction Training Dummy Round 1 about its center axis 16 during both the loading of the firearm magazine assembly 21 and firing of the firearm 17. By this interaction of the second malfunction selection feature 4 and adjacent live ammunition 38, the Malfunction Training Dummy Round 1 will remain in the depicted bolt over base malfunction orientation as the ten rounds of live ammunition 37 above the Malfunction Training Dummy Round 1 are fired by the firearm 17. The conditions depicted in FIG. 18 may be achieved in one of two ways. The firearm operator may choose to train on a simulated bolt over base malfunction, utilizing the second malfunction selection feature 4 to lock the Malfunction Training Dummy Round 1 into the bolt over base malfunction orientation as he or she loads it into the firearm magazine assembly 21. If this option is chosen, the firearm operator will have prior knowledge that a simulated bolt over base malfunction will occur upon firing the firearm 17. Alternatively, the firearm operator may choose to load the Malfunction Training Dummy Round 1 into the firearm magazine assembly 21 without giving regard as to its orientation. This may result in the Malfunction Training Dummy Round 1 locking into the position depicted in FIG. 18 without the firearm operator having prior knowledge that a simulated bolt over base malfunction will occur upon firing the firearm 17. The following steps are performed in order to load a firearm magazine assembly 21 with the Malfunction Training Dummy Round 1 in the bolt over base malfunction orientation as seen in FIG. 18. Starting with a firearm magazine assembly 21 partially loaded with live ammunition 37, the firearm operator inserts the Malfunction Training Dummy Round 1 underneath the left magazine feedlip 42 of the firearm magazine assembly 21. While inserting the Malfunction Training Dummy Round 1 underneath the left magazine feedlip 42, the firearm operator orients the void malfunction feature 2 away from the edge of the left magazine feedlip 24. When the void malfunction feature 2 is oriented such that proper bolt over base malfunction orientation is achieved, adjacent live ammunition 38 enters the second malfunction selection feature 4, locking its orientation by upward spring force 48. The firearm operator then loads ten rounds of live ammunition 37 above the Malfunction Training Dummy Round 1. The firearm magazine assembly 21, now loaded with both live ammunition 37 and the Malfunction Training Dummy Round 1, is inserted into the magazine well 56 of the firearm 17 as is depicted in FIG. 18. The quantity of live ammunition 37 loaded above and below the Malfunction Training Dummy Round 1 may be varied by the firearm operator. Alternatively, the Malfunction Training Dummy Round 1 may be used to simulate bolt over base malfunctions from the right magazine feedlip 43 with all steps and orientations mirror imaged.

Figure 19:
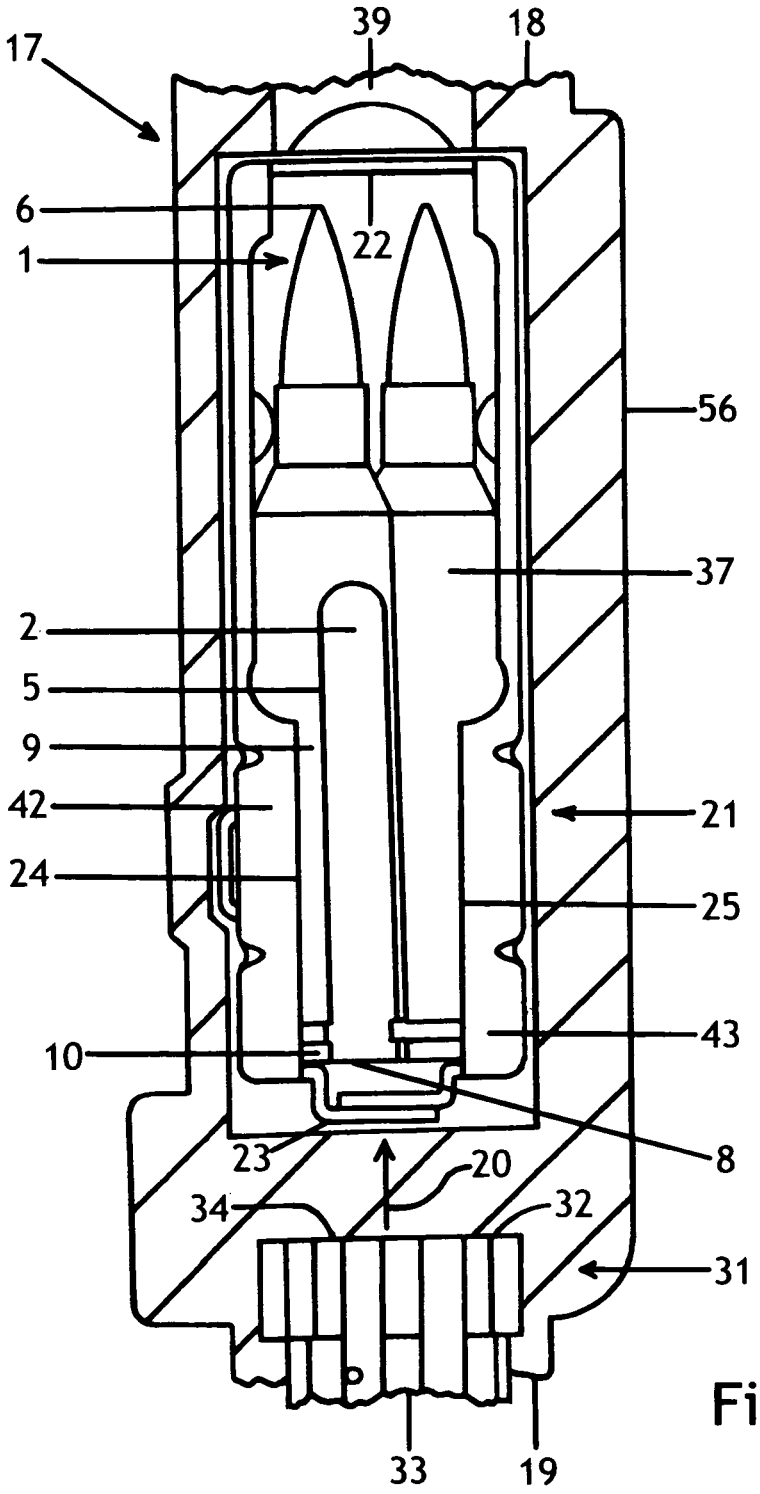
FIG. 19 is a top partial sectional view of the firearm magazine assembly 21 locked into the magazine well 56 of a firearm 17.
Figure 20:
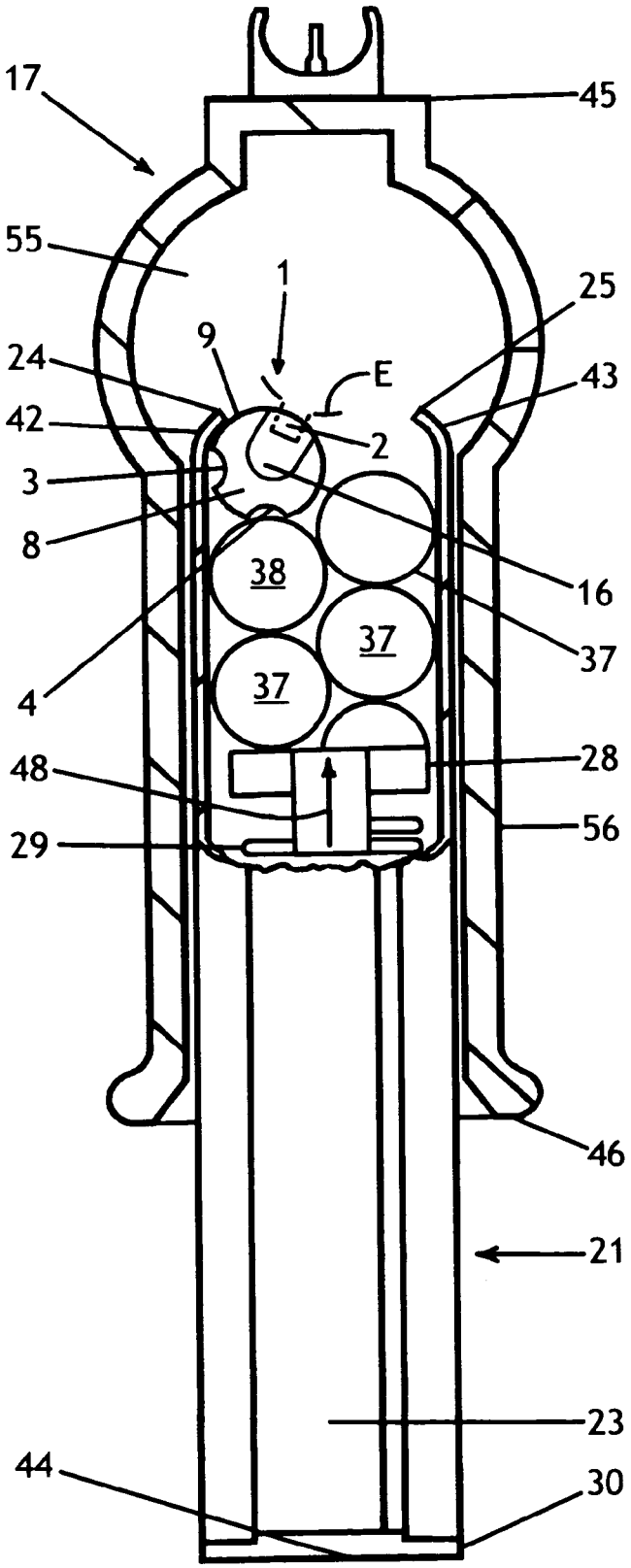
FIG. 20 is a rear partial sectional view of the firearm magazine assembly 21 locked into the magazine well 56 of a firearm 17.

FIG. 19 is a top partial sectional view of the firearm magazine assembly 21 locked into the magazine well 56 of a firearm 17. As also depicted in FIG. 20, FIG. 19 takes place immediately after the conditions depicted in FIG. 18. FIG. 19 depicts the state of the Malfunction Training Dummy Round 1 after the ten rounds of live ammunition 37 seen above the Malfunction Training Dummy Round 1 in FIG. 18 have been fired. FIG. 19 depicts the Malfunction Training Dummy Round 1 as having maintained its bolt over base malfunction orientation, as depicted in FIG. 18, despite having traveled vertically towards the left magazine feedlip 42. As depicted in FIG. 18, FIG. 19 and FIG. 20, bolt over base malfunction orientation is such that the void malfunction feature 2 of the Malfunction Training Dummy Round 1 is oriented away from the edge of the left magazine feedlip 24. As seen particularly well from this top view, in this bolt over base malfunction orientation, the void malfunction feature 2 is aligned with the bolt lug 34 path of forward travel 20. Alignment is such that when the bolt assembly 31 travels forward 20, the bolt lug 34 will enter the void malfunction feature 2 inducing a simulated bolt over base malfunction as seen in FIG. 21.

FIG. 20 is a rear partial sectional view of the firearm magazine assembly 21 locked into the magazine well 56 of a firearm 17. As also depicted in FIG. 19, FIG. 20 takes place immediately after the conditions depicted in FIG. 18. FIG. 20 depicts the state of the Malfunction Training Dummy Round 1 after the ten rounds of live ammunition 37 seen above the Malfunction Training Dummy Round 1 in FIG. 18 have been fired. FIG. 20 depicts the Malfunction Training Dummy Round 1 as having maintained its bolt over base malfunction orientation, as depicted in FIG. 18, despite having traveled vertically towards the left magazine feedlip 42. As depicted in FIG. 18, FIG. 19 and FIG. 20, the bolt over base malfunction orientation is such that the void malfunction feature 2 of the Malfunction Training Dummy Round 1 is oriented away from the edge of the left magazine feedlip 24. Bolt over base malfunction orientation was maintained due to the entrance of adjacent live ammunition 38 into the second malfunction selection feature 4 by upward magazine spring force 48. Therefore, adjacent live ammunition 38 has acted as a spring loaded detent, preventing rotation of the Malfunction Training Dummy Round 1 about its center axis 16. This detent action prevented the Malfunction Training Dummy Round 1 from rotating about its center axis 16 and out of the depicted bolt over base malfunction orientation during firing of the firearm 17. Therefore, the Malfunction Training Dummy Round 1 has remained in the depicted bolt over base malfunction orientation as the ten rounds of live ammunition 37 above the Malfunction Training Dummy Round 1, as seen in FIG. 18, were fired by the firearm 17. Because the outer surface 9 impacts the edge of the left magazine feedlip 24, the Malfunction Training Dummy Round 1 is retained by the firearm magazine assembly 21 until acted upon by bolt lug 34 of the firearm bolt assembly 31. Phantom line E represents the path of the reciprocating firearm bolt assembly 31. Therefore FIG. 20 demonstrates that part of the bolt assembly 31 is aligned with the void malfunction feature 2 such that it will enter the void malfunction feature 2 which will cause the simulated bolt over base malfunction condition as depicted in FIG. 21. Also depicted are:

FIG. 21 is a right side partial sectional view of the firearm magazine assembly 21 locked into the magazine well 56 of a firearm 17. Taking place immediately after the conditions depicted in FIG. 19 and FIG. 20, FIG. 21 depicts a simulated bolt over base malfunction induced by the Malfunction Training Dummy Round 1. As depicted in FIG. 19, FIG. 20 and FIG. 21, a simulated bolt over base malfunction may occur when the bolt lug 34 of the firearm bolt assembly 31 is aligned with the void malfunction feature 2 of the Malfunction Training Dummy Round 1. When the firearm bolt assembly 31 travels forward 20, the bolt lug 34 enters the void malfunction feature 2. Because the bolt lug 34 must contact the rear surface 8 in order to properly feed the Malfunction Training Dummy Round 1 into the firearm chamber 39, the entrance of the bolt lug 34 instead into the void malfunction feature 2 causes the firearm bolt assembly 31 to halt forward travel 20 and the firearm 17 binds into the depicted simulated bolt over base malfunction condition. Simulation of the bolt over base malfunction with the Malfunction Training Dummy Round 1 is particularly realistic. This realism stems from the fact that oftentimes during actual bolt over base malfunctions, the cartridge case of live ammunition 37 is crushed by the bolt lug 34. As depicted in FIG. 21, because the bolt lug 34 enters into the void malfunction feature 2, accurate simulation of firearm bolt assembly 31 final resting position in an actual bolt over base malfunction is provided for. Because the firearm 17 handles differently dependent upon firearm bolt assembly 31 position, this accurate simulation of firearm bolt assembly 31 final resting position in actual bolt over base malfunctions in turn provides the firearm operator with superior training. In addition to simulating bolt over base malfunction with partial feeding as seen in FIG. 21, the Malfunction Training Dummy Round 1 is capable of providing an alternative simulated bolt over base malfunction where the firearm bolt assembly 31 travels forward 20 fully without feeding the Malfunction Training Dummy Round 1 partially into the firearm chamber 39, as depicted n FIG. 21, but instead leaving the Malfunction Training Dummy Round 1 fully in the firearm magazine assembly 21.

Figure 22:
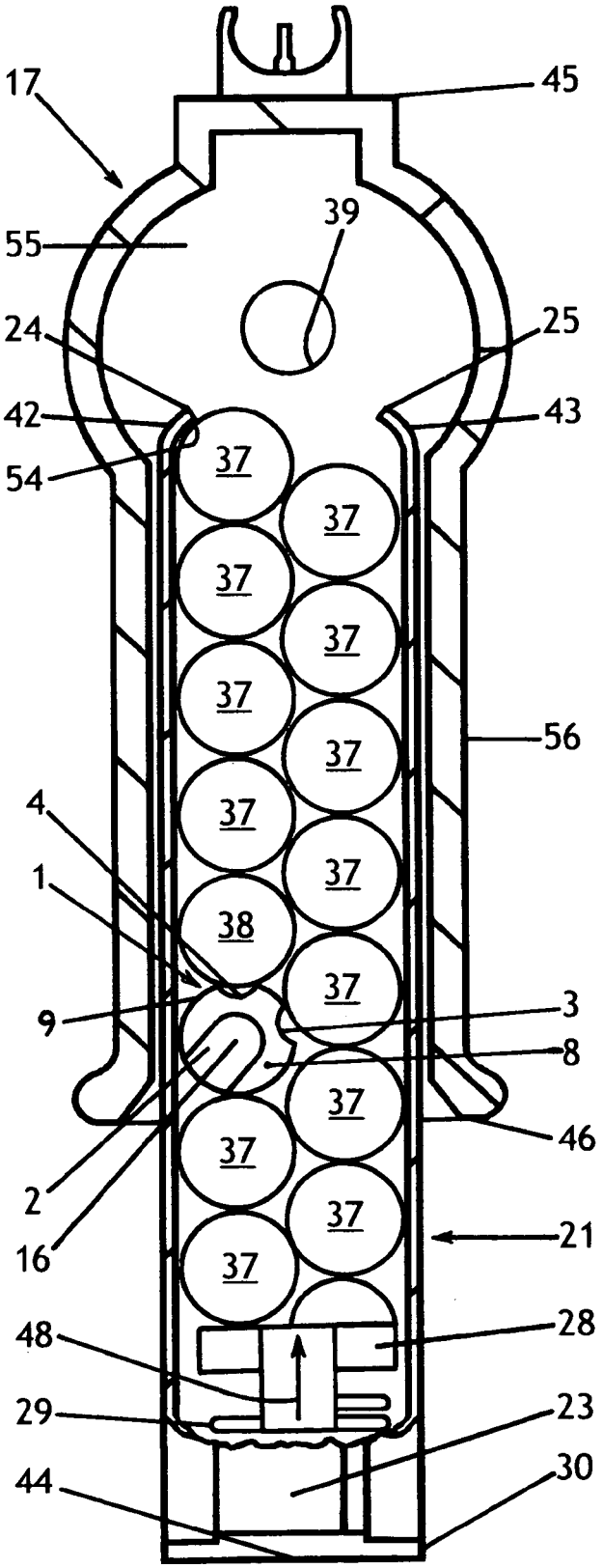
FIG. 22 is a rear partial sectional view of a firearm magazine assembly 21 locked into the magazine well 56 of a firearm 17.
Figure 25:
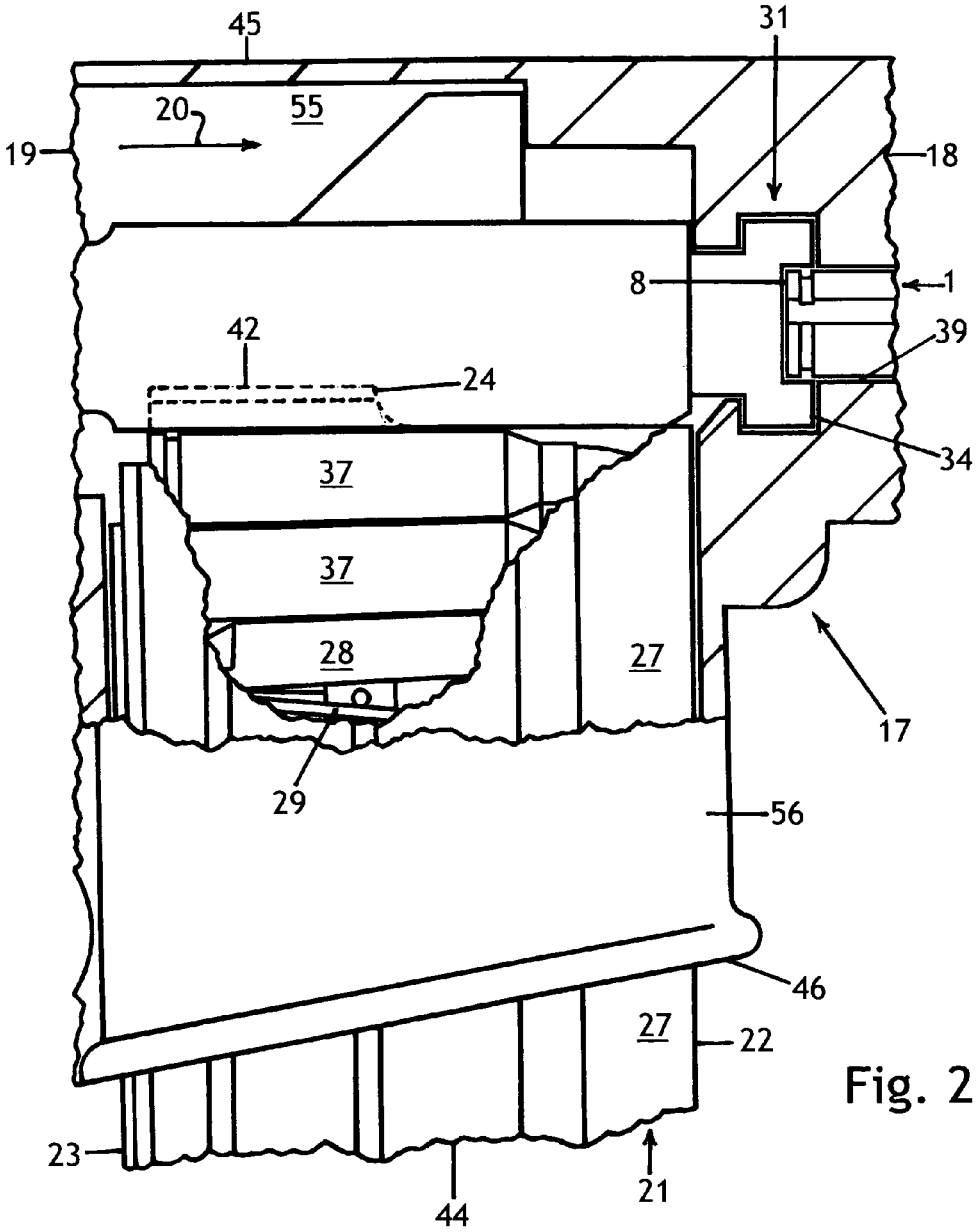
FIG. 25 is a right side partial sectional view of the firearm magazine assembly 21 locked into the magazine well 56 of a firearm 17.

FIG. 22 is a rear partial sectional view of a firearm magazine assembly 21 locked into the magazine well 56 of a firearm 17. FIG. 22 depicts the Malfunction Training Dummy Round 1 as loaded inside the firearm magazine assembly 21 and locked into the failure to fire malfunction orientation. The depicted failure to fire malfunction orientation is such that the Malfunction Training Dummy Round 1 will cause a simulated failure to fire firearm malfunction, as seen in FIG. 25, after the live ammunition 37 above is fired. As depicted in FIG. 22, the failure to fire malfunction orientation is such that the void malfunction feature 2 of the Malfunction Training Dummy Round 1 is oriented downward toward the bottom of the firearm magazine assembly 44 When in this failure to fire malfunction orientation, adjacent live ammunition 38 enters the second malfunction selection feature 4 by upward magazine spring force 48. Therefore adjacent live ammunition 38 acts as a spring loaded detent preventing rotation of the Malfunction Training Dummy Round 1 about its center axis 16 during both the loading of the firearm magazine assembly 21 and firing of the firearm 17. By this interaction of the second malfunction selection feature 4 and adjacent live ammunition 38, the Malfunction Training Dummy Round 1 will remain in the depicted failure to fire malfunction orientation as the nine rounds of live ammunition 37 and one round of adjacent live ammunition 38 above the Malfunction Training Dummy Round 1 are fired by the firearm 17. The conditions depicted in FIG. 22 may be achieved in one of two ways. The firearm operator may choose to train on a simulated failure to fire malfunction, utilizing the second malfunction selection feature 4 to lock the Malfunction Training Dummy Round 1 into the failure to fire malfunction orientation as he or she loads it into the firearm magazine assembly 21. If this option is chosen, the firearm operator will have prior knowledge that a simulated failure to fire malfunction will occur upon firing the firearm 17. Alternatively, the firearm operator may choose to load the Malfunction Training Dummy Round 1 into the firearm magazine assembly 21 without giving regard as to its orientation. This may result in the Malfunction Training Dummy Round 1 locking into the position depicted in FIG. 22 without the firearm operator having prior knowledge that a simulated failure to fire malfunction will occur upon firing the firearm 17. The following steps are performed in order to load a firearm magazine assembly 21 with the Malfunction Training Dummy Round 1 in the failure to fire malfunction orientation as seen in FIG. 22. Starting with a firearm magazine assembly 21 partially loaded with live ammunition 37, the firearm operator inserts the Malfunction Training Dummy Round 1 underneath the left magazine feedlip 42 of the firearm magazine assembly 21. While inserting the Malfunction Training Dummy Round 1 underneath the left magazine feedlip 42, the firearm operator orients the void malfunction feature 2 of the Malfunction Training Dummy Round 1 downward toward the bottom of the firearm magazine assembly 44. When the void malfunction feature 2 is oriented such that proper failure to fire malfunction orientation is achieved, the firearm operator loads one round of live ammunition 37 and then loads adjacent live ammunition 38 such that it enters the second malfunction selection feature 4, locking the Malfunction Training Dummy Round 1 orientation by upward magazine spring force 48. The firearm operator then loads the remaining eight rounds of live ammunition 37 above the Malfunction Training Dummy Round 1. The firearm magazine assembly 21, now loaded with both live ammunition 37 and the Malfunction Training Dummy Round 1, is inserted into the magazine well 56 of the firearm 17 as is depicted in FIG. 22. The quantity of live ammunition 37 loaded above and below the Malfunction Training Dummy Round 1 may be varied by the firearm operator. Alternatively, the Malfunction Training Dummy Round 1 may be used to simulate failure to fire malfunctions from the right magazine feedlip 43 with all steps and orientations mirror imaged.

Figure 23:
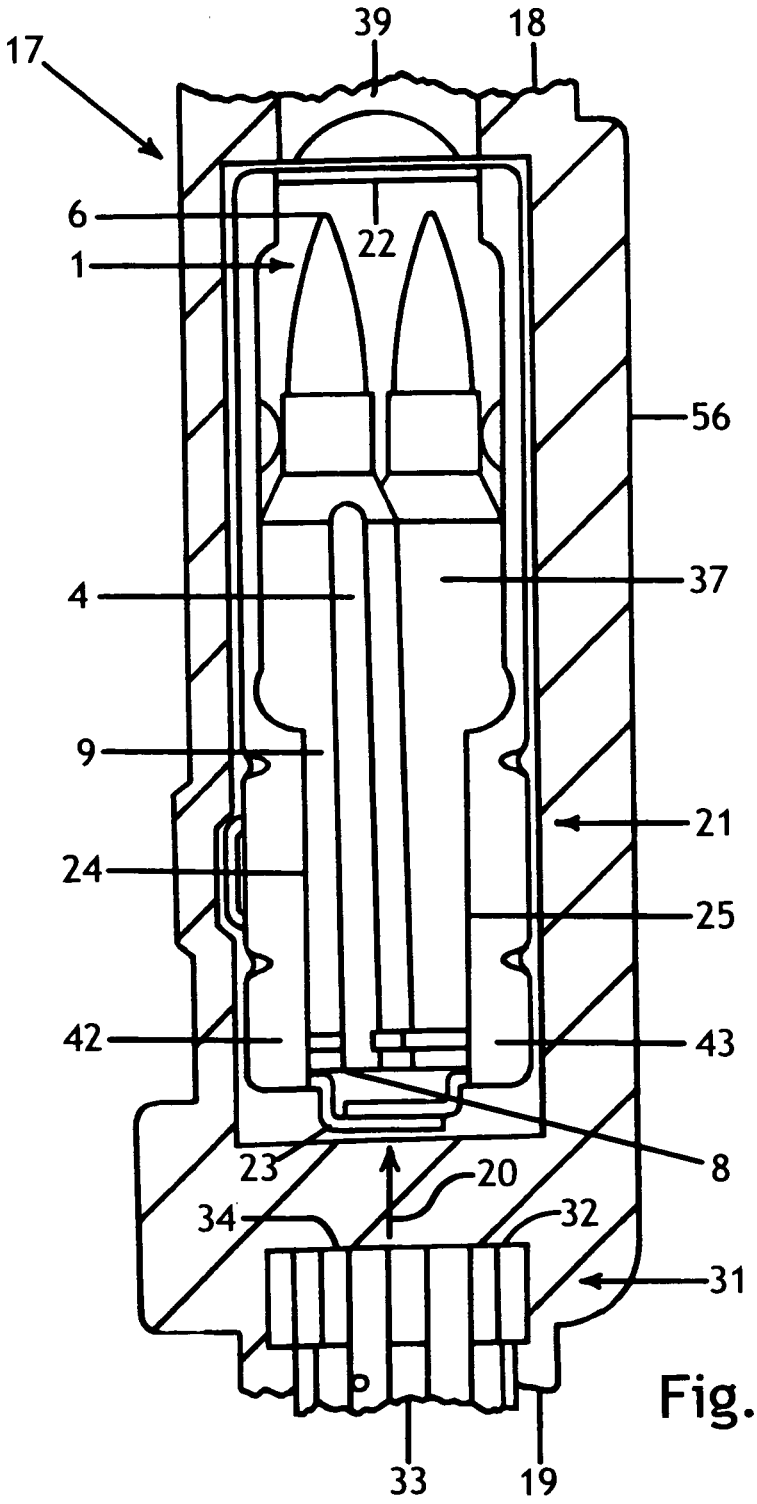
FIG. 23 is a top partial sectional view of the firearm magazine assembly 21 locked into the magazine well 56 of a firearm 17.
Figure 24:
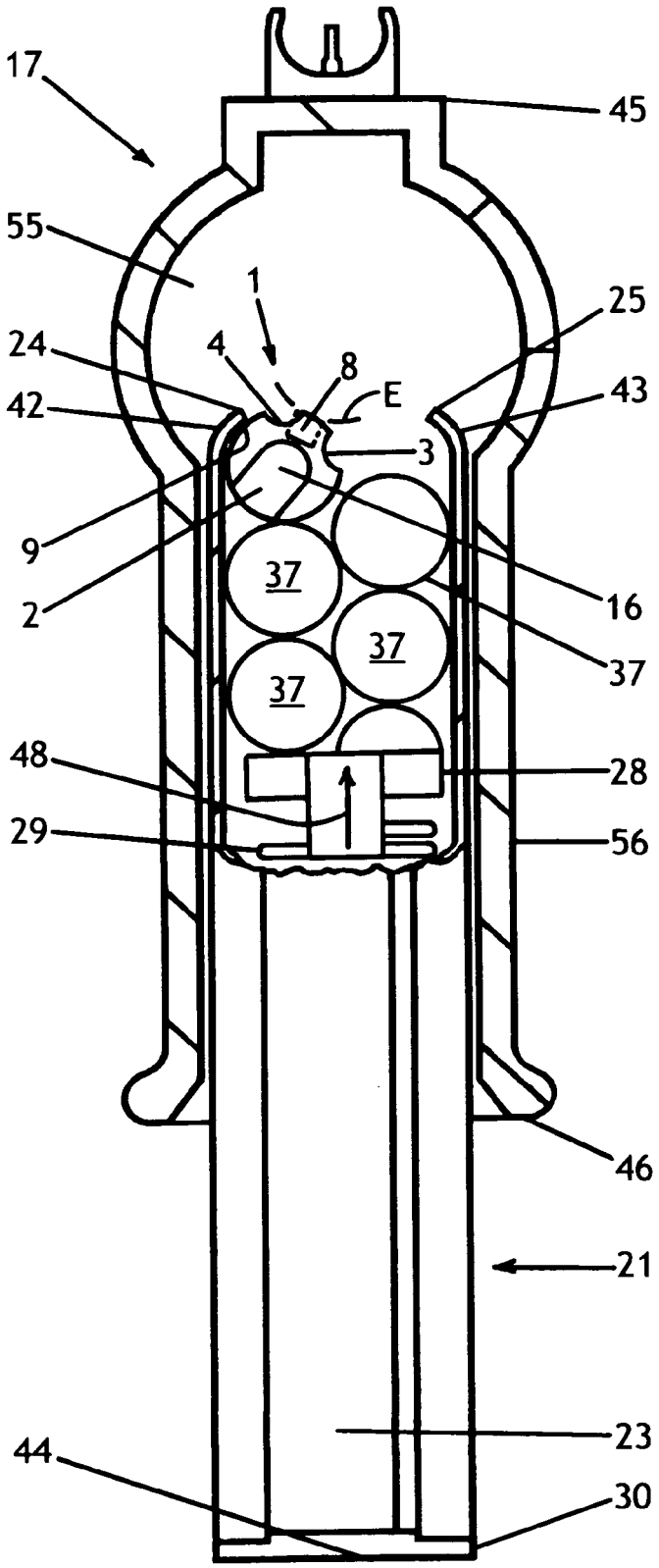
FIG. 24 is a rear partial sectional view of the firearm magazine assembly 21 locked into the magazine well 56 of a firearm 17.

FIG. 23 is a top partial sectional view of the firearm magazine assembly 21 locked into the magazine well 56 of a firearm 17. As also depicted in FIG. 24, FIG. 23 takes place immediately after the conditions depicted in FIG. 22. FIG. 23 depicts the state of the Malfunction Training Dummy Round 1 after the nine rounds of live ammunition 37 and one round of adjacent live ammunition 38 seen above the Malfunction Training Dummy Round 1 in FIG. 22 have been fired. FIG. 23 depicts the Malfunction Training Dummy Round 1 as having maintained its failure to fire malfunction orientation, as depicted in FIG. 22, despite having traveled vertically towards the left magazine feedlip 42. As depicted in FIG. 22, FIG. 23 and FIG. 24, failure to fire malfunction orientation is such that the void malfunction feature 2 of the Malfunction Training Dummy Round 1 is oriented downward toward the bottom of the firearm magazine assembly 44. As seen particularly well from this top view, in this failure to fire malfunction orientation, the rear surface 8 of the malfunction training dummy round 1 is aligned with the bolt lug 34 path of forward travel 20. Alignment is such that when the firearm bolt assembly 31 travels forward 20, the bolt lug 34 will contact the rear surface 8 and load the Malfunction Training Dummy Round 1 into the firearm chamber 39 therefore inducing a simulated failure to fire malfunction as seen in FIG. 25.

FIG. 24 is a rear partial sectional view of the firearm magazine assembly 21 locked into the magazine well 56 of a firearm 17. As also depicted in FIG. 23, FIG. 24 takes place immediately after the conditions depicted in FIG. 22. FIG.

Figure 26:
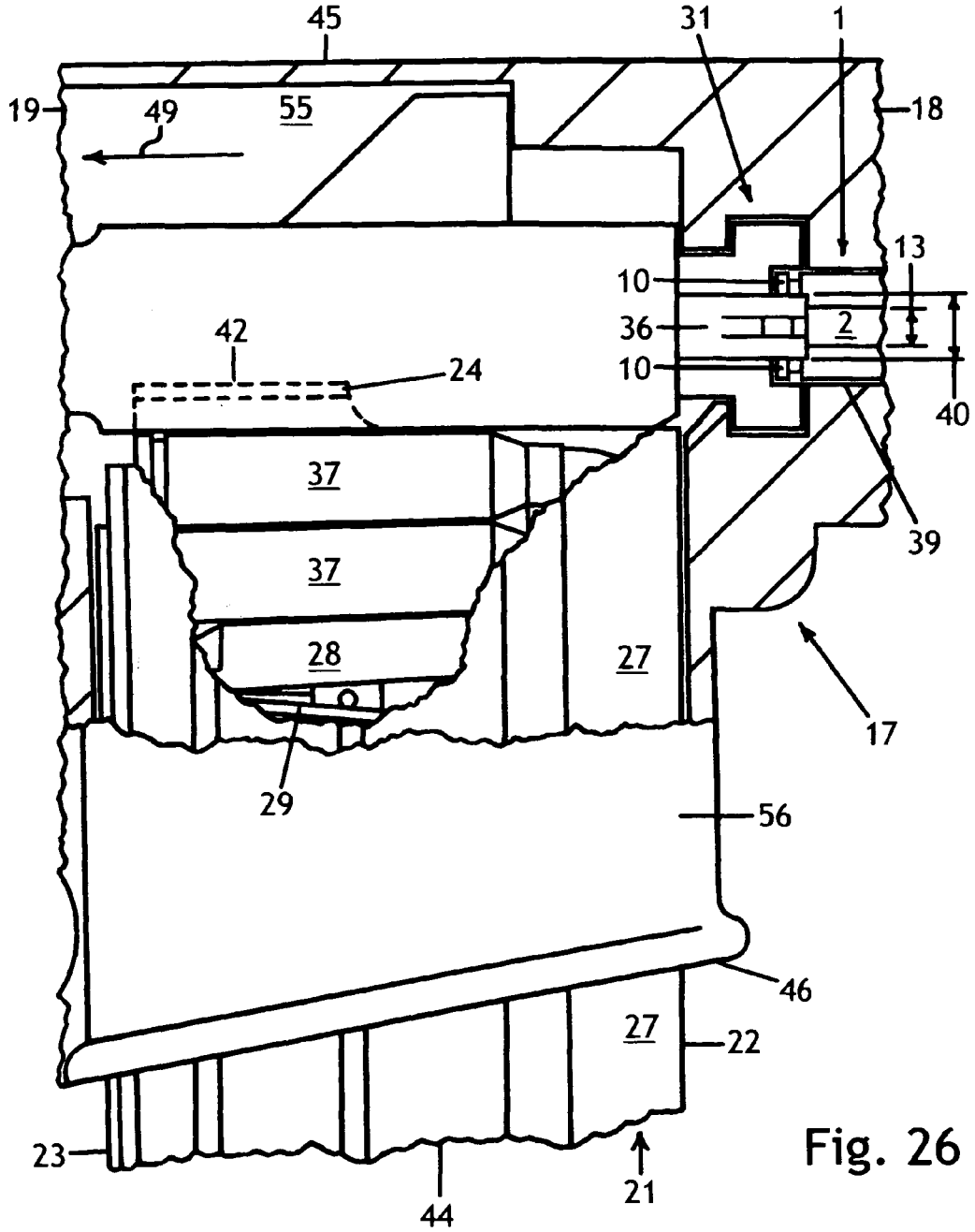
FIG. 26 is a right side partial sectional view of the firearm magazine assembly 21 locked into the magazine well 56 of a firearm 17.
Figure 27:
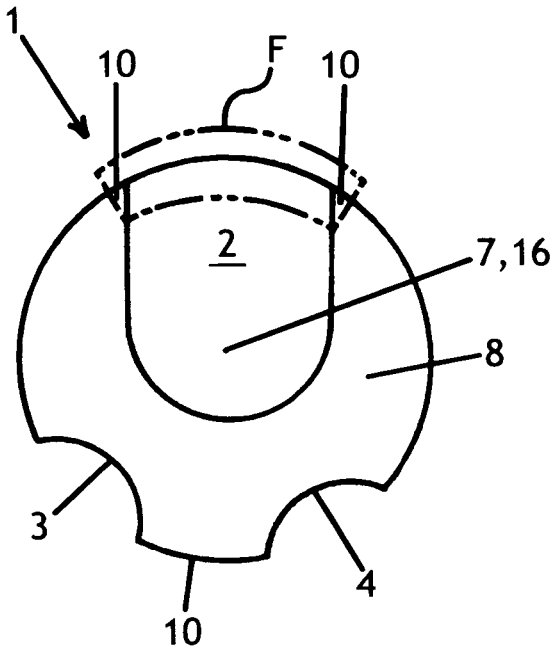
FIG. 27 is a rear view of the Malfunction Training Dummy Round 1 depicting the relationship between one embodiment of the Malfunction Training Dummy Round 1 and a firearm extractor represented by phantom line F. In the particular embodiment of the Malfunction Training Dummy Round 1 depicted in both FIG. 26 and FIG. 27, the void malfunction feature 2 is configured such that the extractor represented by phantom line F can always engage part of the extraction rim 10 of the Malfunction Training Dummy Round 1.

24 depicts the state of the Malfunction Training Dummy Round 1 after the nine rounds of live ammunition 37 and one round of adjacent live ammunition 38 seen above the Malfunction Training Dummy Round 1 in FIG. 22 have been fired. FIG. 24 depicts the Malfunction Training Dummy Round 1 as having maintained its failure to fire malfunction orientation, as depicted in FIG. 22, despite having traveled vertically towards the left magazine feedlip 42. As depicted in FIG. 22, FIG. 23 and FIG. 24, failure to fire malfunction orientation is such that the void malfunction feature 2 of the Malfunction Training Dummy Round 1 is oriented downward toward bottom of the firearm magazine 44. Failure to fire malfunction orientation was maintained due to the entrance of adjacent live ammunition 38 into the second malfunction selection feature 4 by magazine spring force 48 as seen in FIG. 22. Therefore, adjacent live ammunition 38 has acted as a spring loaded detent, preventing rotation of the Malfunction Training Dummy Round 1 about its center axis 16. This detent action prevented the Malfunction Training Dummy Round 1 from rotating out of the depicted failure to fire malfunction orientation about its center axis 16 during the firing of the firearm 17. Therefore, the Malfunction Training Dummy Round 1 has remained in the depicted failure to fire malfunction orientation as the nine rounds of live ammunition 37 and one round of adjacent live ammunition 38 seen above the Malfunction Training Dummy Round 1, as seen in FIG. 22, were fired by the firearm 17. Because the outer surface 9 impacts the edge of the left magazine feedlip 24, the Malfunction Training Dummy Round 1 is retained by the firearm magazine assembly 21 until acted upon by bolt lug 34 of the firearm bolt assembly 31. Phantom line E represents the path of the reciprocating firearm bolt assembly 31. Therefore, FIG. 24 demonstrates that part of the bolt assembly 31 is aligned with the rear surface 8 of the malfunction training dummy round 1. Therefore, it is apparent that part of the bolt assembly 31 will contact the rear surface 8 and load the Malfunction Training Dummy Round 1 into the firearm chamber 39, causing the simulated failure to fire malfunction condition as depicted in FIG. 25. Also depicted are:

FIG. 25 is a right side partial sectional view of the firearm magazine assembly 21 locked into the magazine well 56 of a firearm 17. Taking place immediately after the conditions depicted in FIG. 23 and FIG. 24, FIG. 25 depicts a simulated failure to fire malfunction induced by the Malfunction Training Dummy Round 1. As depicted in FIG. 23 and FIG. 24, a simulated failure to fire malfunction may occur when the bolt lug 34 of the firearm bolt assembly 31 is aligned with the rear surface 8 of the Malfunction Training Dummy Round 1. Alignment is such that when the bolt assembly 31 travels forward 20, the bolt lug 34 contacts the rear surface 8 and loads the Malfunction Training Dummy Round 1 into the firearm chamber 39 as seen in FIG. 25. The Malfunction Training Dummy Round 1 is inert, therefore when the firearm operator attempts to fire the firearm 17 a simulated failure to fire malfunction will occur. Now loaded into the firearm chamber 39, the Malfunction Training Dummy Round 1 is capable being extracted and ejected without further malfunction as depicted in FIG. 26 and FIG. 27. Alternatively, the Malfunction Training Dummy Round 1, or embodiments thereof, may induce both failure to extract and failure to eject malfunctions as depicted in FIG. 28, FIG. 29, FIG. 30 and FIG. 31.

FIG. 26 is a right side partial sectional view of the firearm magazine assembly 21 locked into the magazine well 56 of a firearm 17. FIG. 26 depicts one of the possible variations of the failure to fire malfunction depicted in FIG. 25. In the particular embodiment of the Malfunction Training Dummy Round 1 depicted in both FIG. 26 and FIG. 27, the void malfunction feature width 13 is less than the width of extractor 40. Therefore the extractor 36 is able to engage the extraction rim 10 of the Malfunction Training Dummy Round 1 indifferent of the orientation of the Malfunction Training Dummy Round 1 inside the firearm chamber 39. Thus in this particular embodiment when the firearm operator attempts to resolve a simulated failure to fire malfunction as seen FIG. 25 by retracting the bolt assembly 31 to the rear 49, the Malfunction Training Dummy Round 1 will be extracted from the firearm chamber 39.

FIG. 27 is a rear view of the Malfunction Training Dummy Round 1 depicting the relationship between one embodiment of the Malfunction Training Dummy Round 1 and a firearm extractor represented by phantom line F. In the particular embodiment of the Malfunction Training Dummy Round 1 depicted in both FIG. 26 and FIG. 27, the void malfunction feature 2 is configured such that the extractor represented by phantom line F can always engage part of the extraction rim 10 of the Malfunction Training Dummy Round 1. In this particular embodiment, the size of the void malfunction feature 2 relative to the size of the extractor represented by phantom line F ensures that no orientation of the Malfunction Training Dummy Round 1 around its center axis 16 would prevent the extractor represented by phantom line F from engaging part of the extraction rim 10 of the Malfunction Training Dummy Round 1. Thus with this particular embodiment, when the firearm operator attempts to resolve a simulated failure to fire malfunction as seen in FIG. 25, the Malfunction Training Dummy Round 1 in this particular embodiment will be engaged by the extractor represented by phantom line F.

Figure 28:
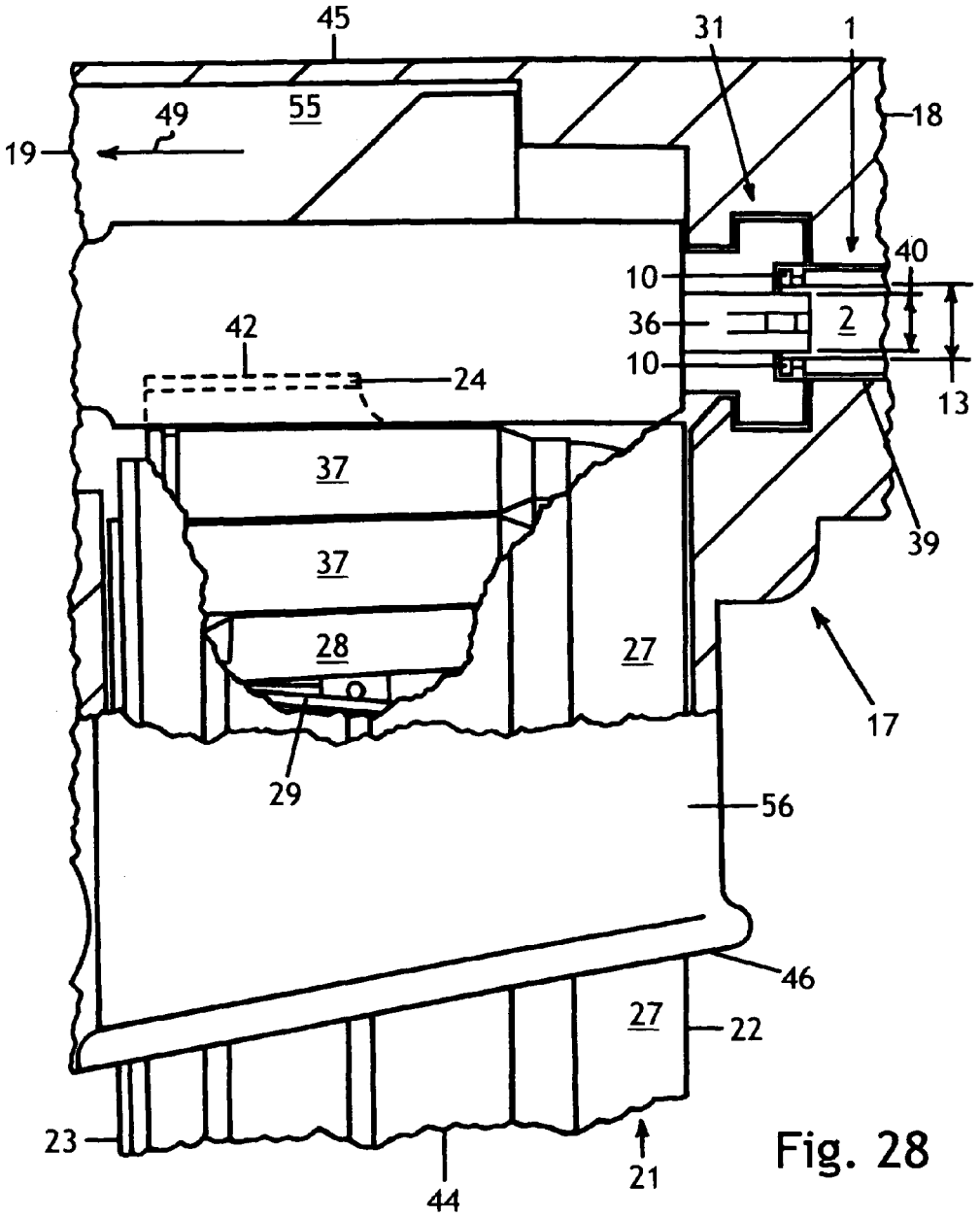
FIG. 28 is a right side partial sectional view of the firearm magazine assembly 21 locked into the magazine well 56 of a firearm 17.

FIG. 28 is a right side partial sectional view of the firearm magazine assembly 21 locked into the magazine well 56 of a firearm 17. FIG. 28 depicts one of the possible variations of the failure to fire malfunction depicted in FIG. 25. In the particular embodiment of the Malfunction Training Dummy Round 1 depicted in both FIG. 28 and FIG. 29, the void malfunction feature width 13 is more than the width of extractor 40. Therefore the extractor 36 is unable to engage the extraction rim 10 of the Malfunction Training Dummy Round 1 in certain orientations of the Malfunction Training Dummy Round 1 inside the firearm chamber 39. Thus in this particular embodiment when the firearm operator attempts to resolve a simulated failure to fire malfunction as seen FIG. 25 by retracting the bolt assembly 31 to the rear 49, the Malfunction Training Dummy Round 1 may not be extracted from the firearm chamber 39. Thus a simulated failure to extract malfunction after a simulated failure to fire malfunction may be induced by this particular embodiment of the Malfunction Training Dummy Round 1.

Figure 29:
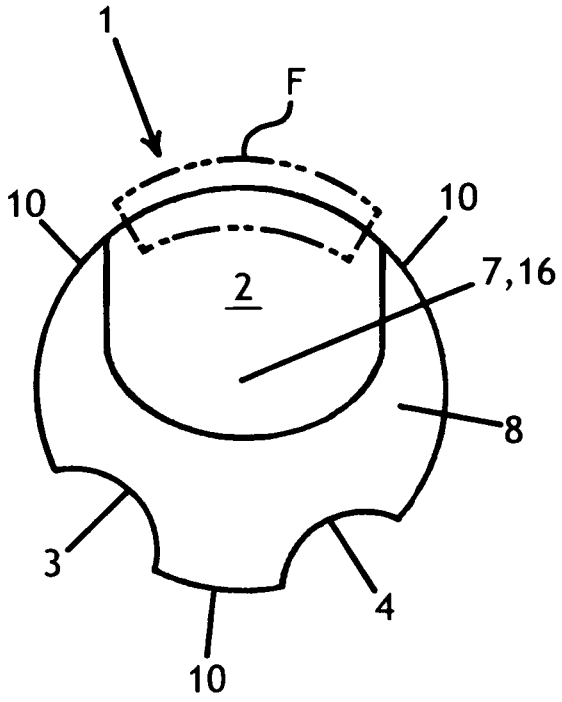
FIG. 29 is a rear view of the Malfunction Training Dummy Round 1 depicting the relationship between one particular embodiment of the Malfunction Training Dummy Round 1 and a firearm extractor represented by phantom line F. In the particular embodiment of the Malfunction Training Dummy Round 1 depicted in both FIG. 28 and FIG. 29, the void malfunction feature 2 is configured such that the extractor represented by phantom line F may not be able engage the extraction rim 10 of the Malfunction Training Dummy Round 1.

FIG. 29 is a rear view of the Malfunction Training Dummy Round 1 depicting the relationship between one particular embodiment of the Malfunction Training Dummy Round 1 and a firearm extractor represented by phantom line F. In the particular embodiment of the Malfunction Training Dummy Round 1 depicted in both FIG. 28 and FIG. 29, the void malfunction feature 2 is configured such that the extractor represented by phantom line F may not be able engage the extraction rim 10 of the Malfunction Training Dummy Round 1. In this particular embodiment, the size of the void malfunction feature 2 relative to the size of the extractor represented by phantom line F is such that in some orientations of the Malfunction Training Dummy Round 1 around its center axis 16 the extractor represented by phantom line F would not be able engage the extraction rim 10 of the Malfunction Training Dummy Round 1. Thus in this particular embodiment when the firearm operator attempts to resolve a simulated failure to fire malfunction as seen FIG. 25 the Malfunction Training Dummy Round 1 shown in this particular embodiment may not be extracted from the firearm chamber 39.

Figure 30:
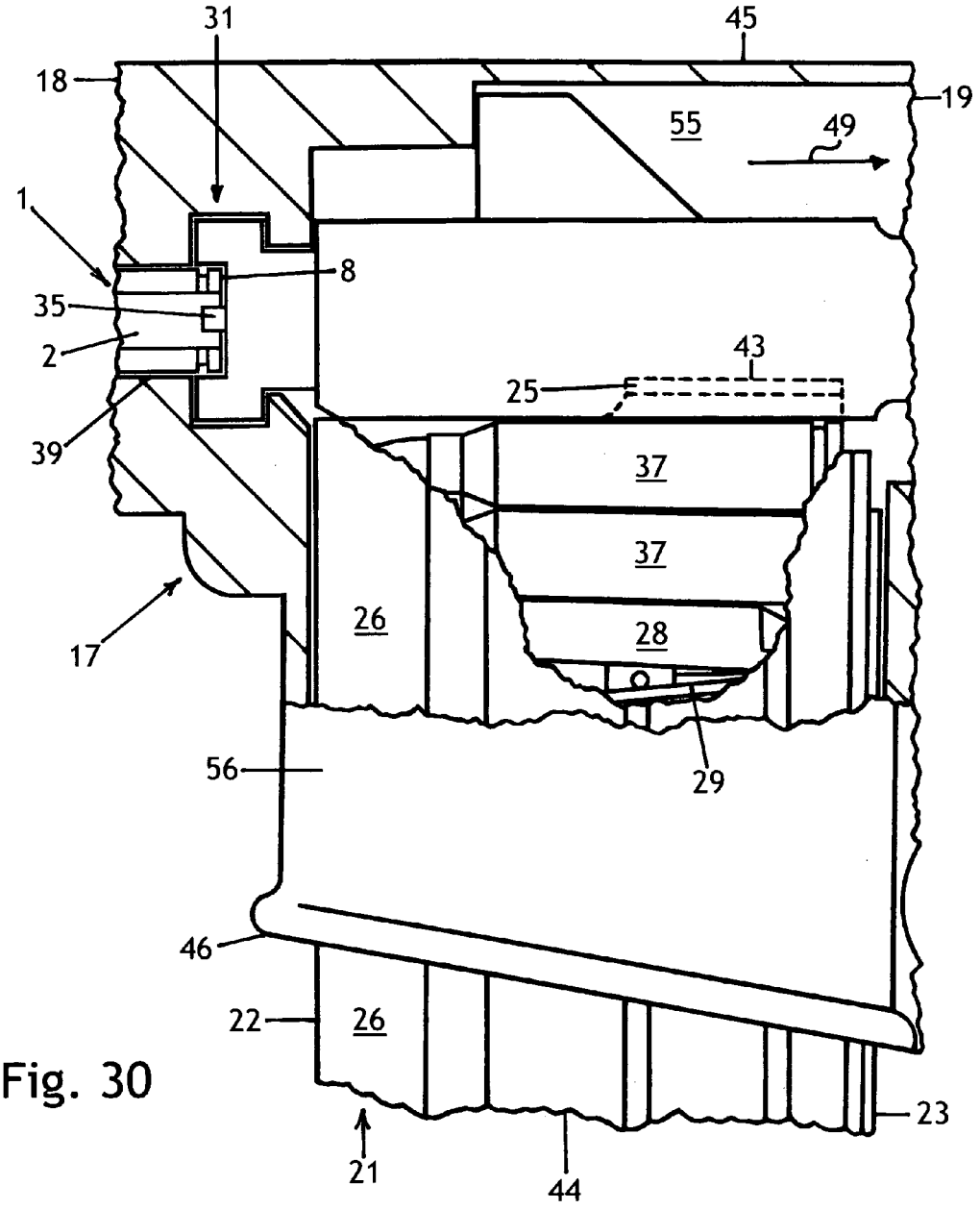
FIG. 30 is a left side partial sectional view of the firearm magazine assembly 21 locked into the magazine well 56 of a firearm 17.

FIG. 30 is a left side partial sectional view of the firearm magazine assembly 21 locked into the magazine well 56 of a firearm 17. FIG. 30 depicts one of the possible variations of the failure to fire malfunction depicted in FIG. 25. In FIG. 30 the ejector 35 is depicted such that it has entered the void malfunction feature 2 of a particular embodiment of the Malfunction Training Dummy Round 1. By entering the void malfunction feature 2, the ejector 35 is unable to make contact with the rear surface 8. Since the ejector 35 is unable to make contact with the rear surface 8, the ejector will be unable to impart sufficient force to eject the Malfunction Training Dummy Round 1 from the firearm. In some firearm designs known to the art, the Malfunction Training Dummy Round 1 will not even separate from the firearm bolt assembly 31 if the ejector 35 enters the void malfunction feature 2 on this embodiment of the Malfunction Training Dummy Round 1. Thus in this particular embodiment, when the firearm operator attempts to resolve the simulated failure to fire malfunction as seen in FIG. 25 by retracting the bolt assembly 31 to the rear 49, the firearm operator must be careful to notice a simulated failure to eject malfunction has occurred, and take the required actions to ensure the Malfunction Training Dummy Round 1 is removed from the firearm. If the firearm operator fails to do so an operator induced simulated double feed similar to that seen in FIG. 17 will occur. Some particular embodiments of the Malfunction Training Dummy Round 1 incorporate a partial but reduced contact between the rear surface 8 and the ejector 35 such that a reduced ejection force is imparted upon the Malfunction Training Dummy Round 1 by the ejector 35. Reduced ejection force imparted upon the Malfunction Training Dummy Round 1 may result in incomplete ejection and a simulated stovepipe malfunction may result. Thus with this particular embodiment, when the firearm operator attempts to resolve the simulated failure to fire malfunction as seen in FIG. 25 by retracting the firearm bolt assembly 31 to the rear 49, the firearm operator must be careful to notice a simulated stovepipe malfunction has occurred, and take the required actions to ensure the Malfunction Training Dummy Round 1 is removed from the firearm. If the firearm operator fails to do so an operator induced failure to feed may occur. In some particular embodiments of the Malfunction Training Dummy Round 1 a simulated failure to eject malfunction may be user selectable utilizing a malfunction selection feature. Furthermore, simulating a failure to eject malfunction using many of the above embodiments can actually simulate three firearm malfunctions: Firstly a simulated failure to fire malfunction. Secondly a simulated failure to eject malfunction, either a complete or a partial, when the firearm operator attempts to resolve the simulated failure to fire malfunction. Thirdly, if the firearm operator fails to properly notice and correct the simulated failure to eject malfunction, then a third operator induced malfunction, such as a double feed or failure to feed, may occur. This particular arrangement has the novelty of punishing the firearm operator for failing to properly identify and resolve a malfunction by immediately simulating an even more difficult malfunction to resolve.

Figure 31:
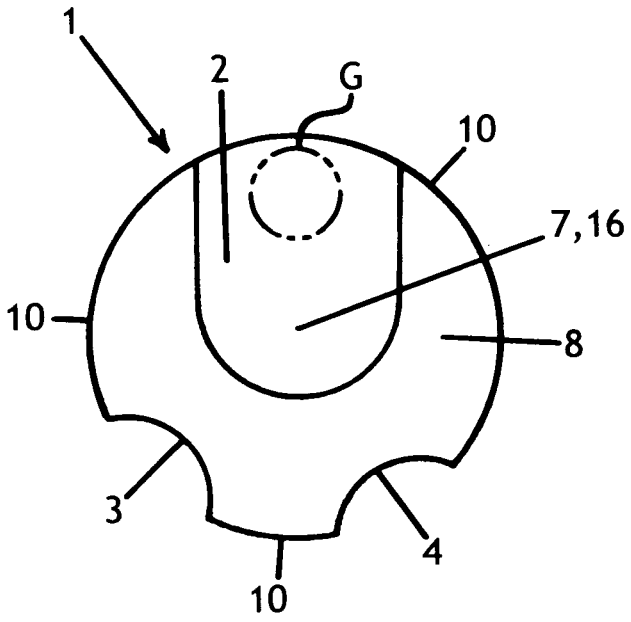
FIG. 31 is a rear view of the Malfunction Training Dummy Round 1 which depicts the relationship between one particular embodiment of Malfunction Training Dummy Round 1 and a firearm ejector represented by phantom line G. In the particular embodiment of the Malfunction Training Dummy Round 1 depicted in both FIG. 30 and FIG. 31, the void malfunction feature 2 is configured such that the ejector represented by phantom line G enters the void malfunction feature 2 of the Malfunction Training Dummy Round 1.

FIG. 31 is a rear view of the Malfunction Training Dummy Round 1 which depicts the relationship between one particular embodiment of Malfunction Training Dummy Round 1 and a firearm ejector represented by phantom line G. In the particular embodiment of the Malfunction Training Dummy Round 1 depicted in both FIG. 30 and FIG. 31, the void malfunction feature 2 is configured such that the ejector represented by phantom line G enters the void malfunction feature 2 and is not able to contact rear surface 8 of the Malfunction Training Dummy Round 1. In this particular embodiment, the size and placement of the void malfunction feature 2 on the Malfunction Training Dummy Round 1 relative to the size of the ejector represented by phantom line G is such that in some orientations of the Malfunction Training Dummy Round 1 around its center axis 16 the ejector represented by phantom line G would not be able contact the rear surface 8 of the Malfunction Training Dummy Round 1. Thus in this particular embodiment when the firearm operator attempts to resolve a simulated failure to fire malfunction as seen FIG. 25 the Malfunction Training Dummy Round 1 shown in this particular embodiment may not be ejected from the firearm. In one embodiment of the Malfunction Training Dummy Round 1 either the first malfunction selection feature 3 or second malfunction selection feature 4 may be arranged such that a particular orientation of the Malfunction Training Dummy Round 1 is induced or maintain such that a simulated failure to eject malfunction may be induced. In another embodiment of the Malfunction Training Dummy Round 1 the void malfunction feature 2 is shaped or placed on that particular embodiment of the Malfunction Training Dummy Round 1 such that partial but incomplete contact between the ejector represented by phantom line G and the rear surface 8 of the Malfunction Training Dummy Round 1, resulting in reduced or limited ejection of the Malfunction Training Dummy Round 1.

DESCRIPTION OF ONE EXEMPLARY EMBODIMENT

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope. The present invention may be embodied in other specific forms without departing from its spirit or essential characteristics. All of the parts discussed above may be made of metal, composite, or plastics. In addition, the parts may be stamped, extruded, molded, cast, forged, or machined. The described embodiments are to be considered in all respects only as illustrative and not restrictive. All changes and alternatives that would be known to one of skill in the art are embraced within the scope of the invention.

As depicted in FIG. 1 and FIG. 2, one exemplary embodiment is comprised of molded high strength polymer, machined metal, or composite material. The present invention as depicted in FIG. 1 and FIG. 2 may be manufactured similarly to existing state of the art dummy rounds, with the addition of a number of voids which run along the length of the Malfunction Training Dummy Round 1. The present invention may be manufactured from any material, but aluminum or polymer would be particularly well suited for use with the Malfunction Training Dummy Round 1. An aluminum embodiment would prove easy to manufacture and very durable, providing long life to the user. The length of the present invention may be turned on a lathe from a rod of aluminum. The rod may be turned down to similar dimensions as live ammunition cartridges for the particular caliber for which the Malfunction Training Dummy Round 1 is to be used. After turning, a number of features such as the depicted void malfunction feature 2, first malfunction selection feature 3 and second malfunction selection feature 4 may be machined down the length of the present invention. The width, depth, length, shape and quantity of these features may vary to allow different types of malfunctions to be induced. Furthermore, the width, depth, length, shape and quantity of these features may vary depending upon firearm in which it is intended to be utilized. Embodiments of the invention could be created for any ammunition cartridge, firearm, including rifles and pistols, and firearm magazine assembly for which malfunction resolution training is desired. Commonly used cartridges for which this invention is of great military, law enforcement and commercial application include 5.56×45 mm NATO, 7.62×51 mm NATO, 7.62×39 mm, 5.45×39 mm, 0.30 Carbine, 9 mm NATO, 0.45ACP, 40S&W, 0.357SIG and many others.

Advantages of the exemplary embodiment are that it is simple, and inexpensive to produce, requiring just two machining operations. Any embodiment or combination of embodiments detailed herein may be machined out of one solid piece of metal, preferably aluminum of sufficient temper, or alternatively, molded polymer. This description is made in terms exemplary and alternative embodiments, and is not intended to be so limited.

I claim:

1. An inert round for training in remediation of malfunctions in a firearm, said firearm having a magazine for containing a plurality of rounds to be introduced into a firing chamber, said magazine having an opening and configured to force said plurality of rounds toward said opening, said opening including at least one feed lip for retaining said plurality of rounds within the magazine, said inert round comprising:

a generally cylindrical body having dimensions substantially conforming to those of a live round that is fired from said firearm, said body having a longitudinal axis; and a malfunction-inducing channel defined longitudinally along said body about a first radius of said body and having a length and a depth such that said feed lip may engage said channel to impart rotation of said inert round prior to introduction into said firing chamber.

2. The inert round of claim 1, wherein the length and the depth of said malfunction-inducing channel are such that a firearm bolt lug may engage said malfunction-inducing channel.

3. The inert round of claim 1, further comprising at least one selection channel defined longitudinally along said body about at least one second radius of said body, said selection channel having a second depth and a second width such that said selection channel engages an adjacent round of said plurality of rounds and prevents said inert round from rotating prior to engagement with said feed lip.

4. A method for inducing firearm malfunctions comprising the steps of:

installing a plurality of rounds into a firearm magazine, said magazine configured with a biasing member to force said plurality of rounds toward an opening along a side of which is a feed lip, wherein said plurality of rounds includes an inert malfunction training round comprising:

a generally cylindrical body having dimensions substantially conforming to those of a live round that is fired from said firearm, said body having a longitudinal axis; and a malfunction-inducing channel defined longitudinally along said body about a first radius of said body and having a length and a depth such that said feed lip may engage said channel to impart rotation of said inert malfunction training round.

5. The method of claim 4, wherein the length and the depth of said malfunction-inducing channel are such that a firearm bolt lug may engage said malfunction-inducing channel.

6. The method of claim 4, wherein said inert malfunction training round further comprises at least one selection channel defined longitudinally along said body about at least one second radius of said body, said selection channel having a second depth and a second width such that said selection channel engages an adjacent round of said plurality of rounds and prevents said inert round from rotating prior to engagement with said feed lip.

7. A system for causing a firearm malfunction for the purpose of malfunction training, comprising:

a firearm, said firearm comprising a firearm bolt assembly, a firearm magazine well and a firearm chamber, said firearm chamber being shaped to accommodate a live ammunition cartridge, said firearm having a forward portion and a rearward portion, said forward portion of said firearm being longitudinally separated from said rearward portion of said firearm by a length of said firearm, said firearm also having a longitudinal axis between said forward portion of said firearm and said rearward portion of said firearm, said firearm bolt assembly having both a position proximate to said firearm chamber as well as a position distant from said firearm chamber within said firearm, said firearm bolt assembly also having a path of bolt reciprocation between said position proximate to said firearm chamber and said position distant from said firearm chamber, said path of bolt reciprocation being essentially parallel to said longitudinal axis, said firearm bolt assembly being conveyable within said firearm from said position proximate to said firearm chamber toward said position distant from said firearm chamber, and vice versa, along said path of bolt reciprocation;

a firearm magazine assembly, said firearm magazine assembly being secured in said firearm magazine well, said firearm magazine assembly comprising a magazine spring and at least one magazine feed lip; and a dummy round, said dummy round being loaded in and internal to said firearm magazine assembly, said dummy round comprising a body, said body having external dimensions substantially conforming to the external dimensions of said live ammunition cartridge, said body further comprising at least one malfunction-inducing channel upon said body, said malfunction-inducing channel allowing said dummy round to rotate about a portion of said magazine feed lip so that, as said firearm bolt assembly is being conveyed along said path of bolt reciprocation, said dummy round bypasses said magazine feed lip and ejects out of said firearm magazine assembly by the urging of said magazine spring, wherein the path of travel of said dummy round during both the bypassing of said magazine feed lip by said dummy round and the ejection of said dummy round out of said firearm magazine assembly is substantially perpendicular to said longitudinal axis of said firearm.

* * * * *